US012262782B2

(12) United States Patent
Elder et al.

(10) Patent No.: US 12,262,782 B2
(45) **Date of Patent: *Apr. 1, 2025**

(54) BLADDER FOR ARTICLE OF FOOTWEAR

(71) Applicant: NIKE, Inc., Beaverton, OR (US)

(72) Inventors: Zachary M. Elder, Portland, OR (US); Roger Paul Murphy, Beaverton, OR (US); Lee D. Peyton, Tigard, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/421,515

(22) Filed: Jan. 24, 2024

(65) Prior Publication Data

US 2024/0156211 A1 May 16, 2024

Related U.S. Application Data

(63) Continuation of application No. 17/317,793, filed on May 11, 2021, now Pat. No. 11,918,074.

(60) Provisional application No. 63/023,271, filed on May 12, 2020.

(51) Int. Cl.

| | |
|---|---|
| ***A43B 13/18*** | (2006.01) |
| ***A43B 13/12*** | (2006.01) |
| ***A43B 13/20*** | (2006.01) |

(52) U.S. Cl.

CPC ..... *A43B 13/189* (2013.01); *A43B 13/127* (2013.01); *A43B 13/20* (2013.01)

(58) Field of Classification Search

CPC ..... A43B 13/189; A43B 13/20; A43B 13/206; A43B 13/127; A43B 13/186; A43B 13/023; A43B 13/125

See application file for complete search history.

(56) References Cited

U.S. PATENT DOCUMENTS

| | | | | |
|---|---|---|---|---|
| 1,504,908 A * | 8/1924 | Sato | A43B 17/08 36/147 |
| 4,999,931 A * | 3/1991 | Vermeulen | A43B 13/185 36/153 |
| 6,402,879 B1 * | 6/2002 | Tawney | A43B 21/285 36/35 R |
| 7,244,483 B2 * | 7/2007 | Tawney | B29D 22/02 36/35 B |

(Continued)

OTHER PUBLICATIONS

European Patent Office, PCT International Search Report/Written Opinion for application No. PCT/US2021/031946, dated Aug. 4, 2021.

(Continued)

*Primary Examiner* — Sharon M Prange

*Assistant Examiner* — Haley A Smith

(74) *Attorney, Agent, or Firm* — Honigman LLP; Matthew H. Szalach; Jonathan P. O'Brien

(57) ABSTRACT

A bladder for an article of footwear includes a plate, a first tensile layer disposed adjacent to a first side of the plate, and a second tensile layer disposed on an opposite side of the plate from the first tensile layer, the second tensile layer joined to the first tensile layer through the plate by a plurality of inner bonds. The bladder additionally includes a first barrier layer disposed adjacent to the first tensile layer and joined to the first tensile layer by a plurality of first outer bonds to form a first chamber, one or more of the first outer bonds interposed between adjacent ones of the inner bonds.

20 Claims, 20 Drawing Sheets

(56) References Cited

U.S. PATENT DOCUMENTS

| | | | | |
|---|---|---|---|---|
| 9,603,414 | B2 * | 3/2017 | Taylor | A43B 13/122 |
| 9,603,415 | B2 * | 3/2017 | Taylor | B32B 3/266 |
| 9,730,487 | B2 * | 8/2017 | Davison | A43B 13/16 |
| 10,376,016 | B2 * | 8/2019 | Davison | A43B 13/185 |
| 10,791,795 | B2 * | 10/2020 | Campos, II | A43B 13/223 |
| 11,013,294 | B2 * | 5/2021 | Davison | B29D 35/122 |
| 2002/0139471 | A1 * | 10/2002 | Tawney | B29D 22/02 156/205 |
| 2011/0203133 | A1 * | 8/2011 | Peyton | A43B 13/20 39/29 |
| 2014/0259749 | A1 | 9/2014 | Taylor | |
| 2016/0295968 | A1 * | 10/2016 | Campos, II | A43B 13/184 |
| 2018/0338575 | A1 | 11/2018 | Elder et al. | |
| 2018/0338577 | A1 | 11/2018 | Elder et al. | |

OTHER PUBLICATIONS

USPTO, Non-Final Office Action for U.S. Appl. No. 17/317,793, mailed Jan. 26, 2023.
USPTO, Final Office Action for U.S. Appl. No. 17/317,793, mailed Aug. 1, 2023.

* cited by examiner

BLADDER FOR ARTICLE OF FOOTWEAR

CROSS REFERENCE TO RELATED APPLICATIONS

This application is a continuation of U.S. application Ser. No. 17/317,793, filed on May 11, 2021, which claims priority under 35 U.S.C. § 119(e) to U.S. Provisional Application No. 63/023,271, filed on May 12, 2020. The disclosures of these prior applications are considered part of the disclosure of this application and are hereby incorporated by reference in their entirety.

FIELD

The present disclosure relates generally to bladders for articles of footwear, and to methods of making bladders for articles of footwear.

BACKGROUND

This section provides background information related to the present disclosure, which is not necessarily prior art.

Articles of footwear conventionally include an upper and a sole structure. The upper may be formed from any suitable material(s) to receive, secure, and support a foot on the sole structure. The upper may cooperate with laces, straps, or other fasteners to adjust the fit of the upper around the foot. A bottom portion of the upper, proximate to a bottom surface of the foot, attaches to the sole structure.

Sole structures generally include a layered arrangement extending between a ground surface and the upper. One layer of the sole structure includes an outsole that provides abrasion-resistance and traction with the ground surface. The outsole may be formed from rubber or other materials that impart durability and wear-resistance, as well as enhance traction with the ground surface. Another layer of the sole structure includes a midsole disposed between the outsole and the upper. The midsole provides cushioning for the foot and may be partially formed from a polymer foam material that compresses resiliently under an applied load to cushion the foot by attenuating ground-reaction forces. The midsole may additionally incorporate a fluid-filled chamber to increase durability of the sole structure, as well as to provide cushioning to the foot by compressing resiliently under an applied load to attenuate ground-reaction forces. Sole structures may also include a comfort-enhancing insole or a sockliner located within a void proximate to the bottom portion of the upper and a stroble attached to the upper and disposed between the midsole and the insole or sockliner.

Fluid-filled chambers for use in footwear are typically formed from two barrier layers of polymer material that are sealed or bonded together to form a chamber. Often, the chamber is pressurized with a fluid, such as air, and may incorporate tensile members to retain a desired shape of the chamber when pressurized. Generally, fluid-filled chambers are designed with an emphasis on balancing support for the foot and cushioning characteristics that relate to responsiveness as the fluid-filled chamber resiliently compresses under an applied load. The fluid-filled chamber as a whole, however, fails to adequately dampen oscillations by the foot as the fluid-filled chamber compresses to attenuate ground-reaction forces. Accordingly, creating a midsole from a fluid-filled chamber that dampens foot oscillation and provides acceptable cushioning for the foot while attenuating ground-reaction forces is difficult to achieve.

DRAWINGS

The drawings described herein are for illustrative purposes only of selected configurations and are not intended to limit the scope of the present disclosure.

Corresponding reference numerals indicate corresponding parts throughout the drawings.

DETAILED DESCRIPTION

Figure 1A:
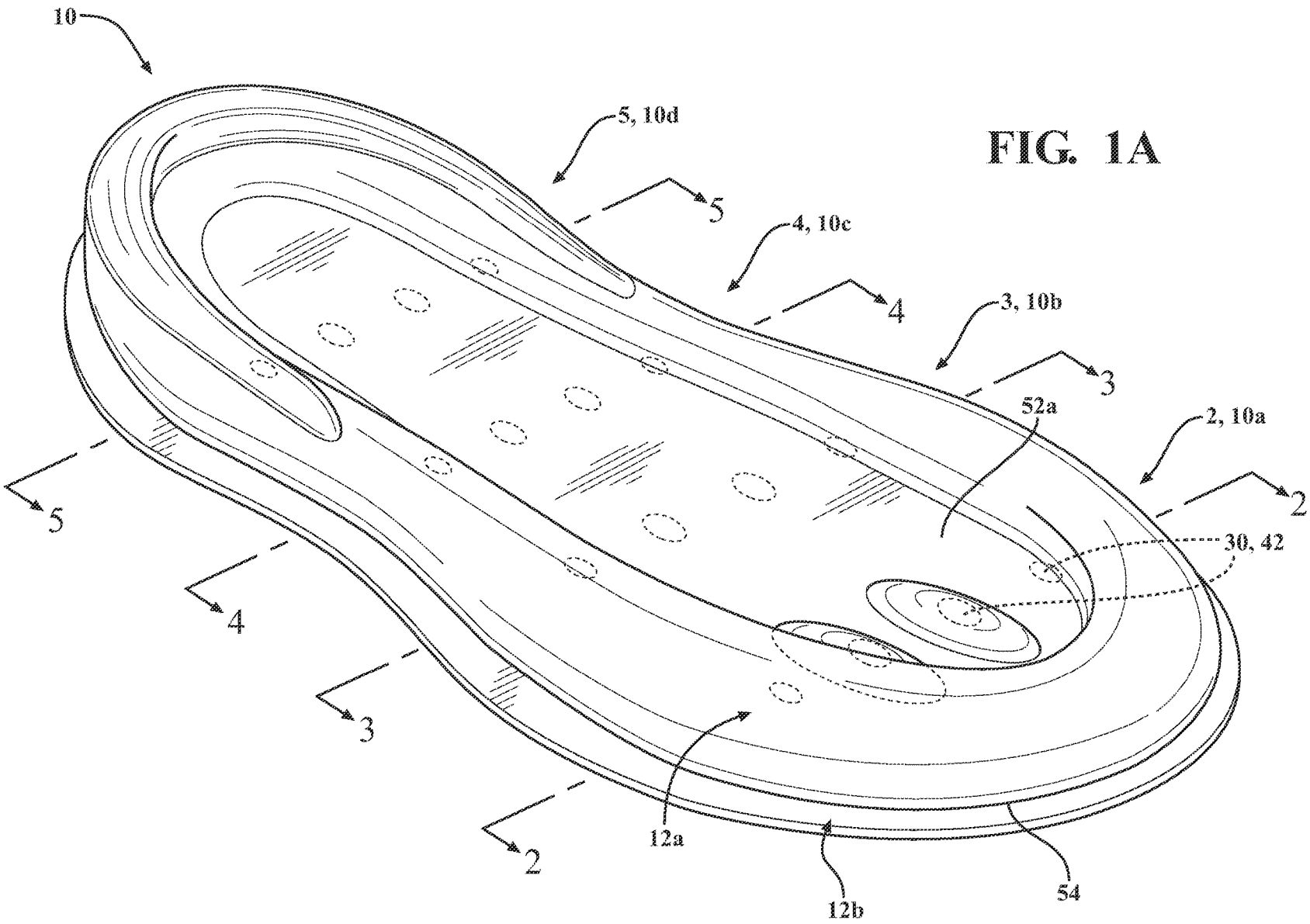
FIG. 1A is a perspective view of a bladder for an article of footwear in accordance with principles of the present disclosure.

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

In one configuration, a bladder for an article of footwear is provided and includes a plate, a first tensile layer disposed adjacent to a first side of the plate, and a second tensile layer disposed on an opposite side of the plate from the first tensile layer, the second tensile layer joined to the first tensile layer through the plate by a plurality of inner bonds. The bladder additionally includes a first barrier layer disposed adjacent to the first tensile layer and joined to the first tensile layer by a plurality of first outer bonds to form a first chamber, one or more of the first outer bonds interposed between adjacent ones of the inner bonds.

The bladder may include one or more of the following optional features. For example, the first tensile layer and the second tensile layer may be formed of a first elastomeric material and the first barrier layer may be formed of a second elastomeric material different from the first elastomeric material. Additionally or alternatively, the first elastomeric material may have a lower melting temperature than the second elastomeric material.

In one configuration, a second barrier layer may be disposed adjacent to the second tensile layer and may be joined to the second tensile layer by a plurality of second outer bonds to form a second chamber on the opposite side of the plate than the first chamber. In this configuration, the first chamber may be fluidly isolated from the second chamber by at least one of the first tensile layer and the second tensile layer. Additionally or alternatively, the first chamber may have a different pressure than the second chamber.

The plate may include a plurality of apertures extending through the plate with each of the inner bonds being formed within one of the apertures.

In one configuration, the second tensile layer may be joined to the first tensile layer around a periphery of the plate. Additionally or alternatively, the first tensile layer and the second tensile layer may be detached from the plate between the inner bonds to form one or more tensile elements. Further, each of the first outer bonds may be formed with one of the tensile elements.

In another configuration, a bladder for an article of footwear is provided and includes a plate having one or more apertures, a first tensile layer disposed adjacent to a first side of the plate, a second tensile layer disposed on an opposite side of the plate from the first tensile layer and joined to the first tensile layer within each of the one or more apertures, and a first barrier layer disposed adjacent to the first tensile layer and joined to the first tensile layer at discrete locations to form a first chamber.

The bladder may include one or more of the following optional features. For example, the first tensile layer and the second tensile layer may be formed of a first elastomeric material and the first barrier layer may be formed of a second elastomeric material different from the first elastomeric material. Additionally or alternatively, the first elastomeric material may have a lower melting temperature than the second elastomeric material.

A second barrier layer may be disposed adjacent to the second tensile layer and may be joined to the second tensile layer by a plurality of second outer bonds to form a second chamber on the opposite side of the plate than the first chamber. The first chamber may be fluidly isolated from the second chamber by at least one of the first tensile layer and the second tensile layer. The first chamber may have a different pressure than the second chamber.

In one configuration, the second tensile layer may be joined to the first tensile layer around a periphery of the plate. Additionally or alternatively, the first tensile layer and the second tensile layer may be detached from the plate between the apertures to form one or more tensile elements. In this configuration, the first barrier layer may be attached to each of the one or more tensile elements of the first tensile layer and/or may be attached to the first tensile layer along each of the apertures.

Figure 1B:
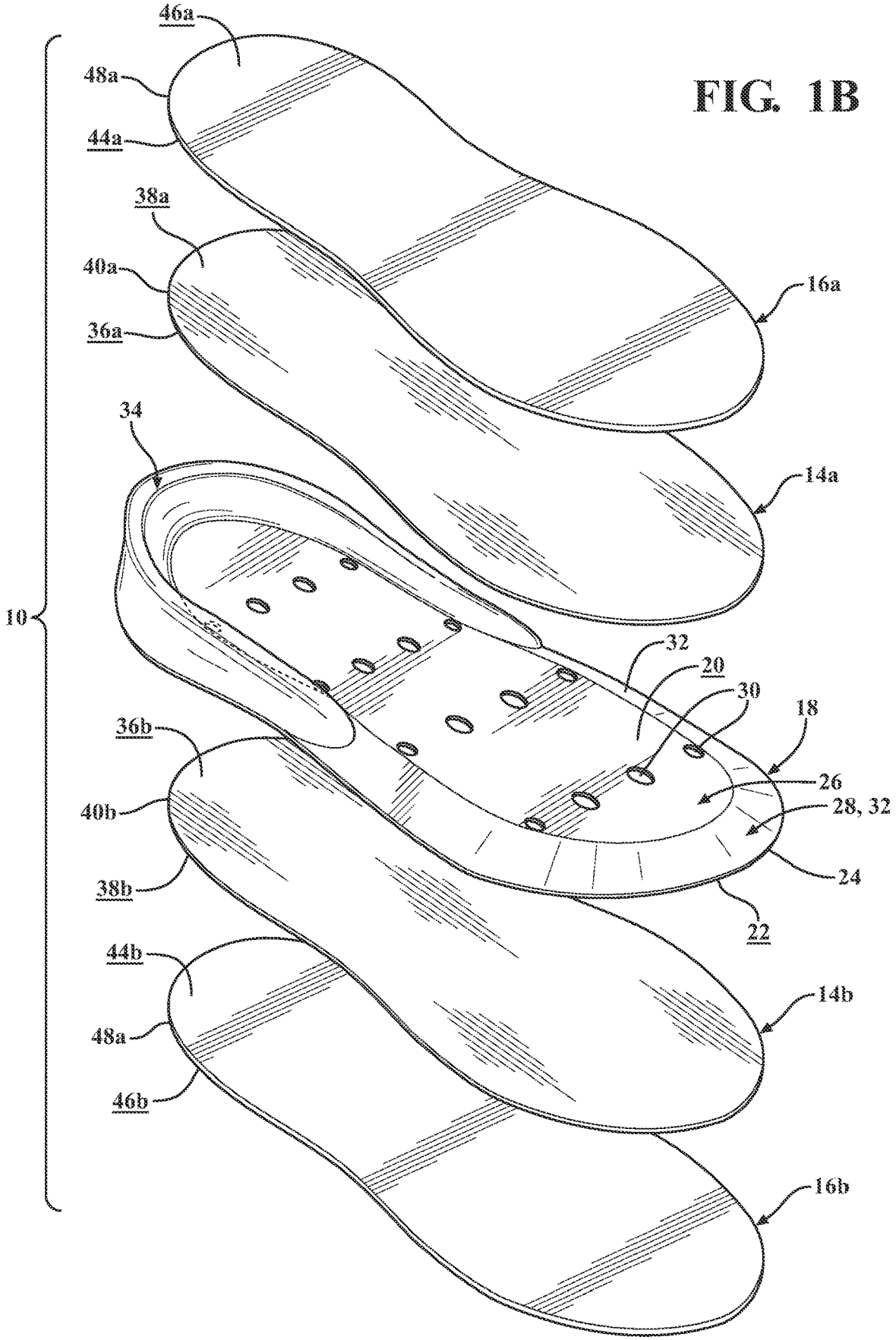
FIG. 1B is an exploded perspective view of the bladder of FIG. 1A.
Figure 1C:
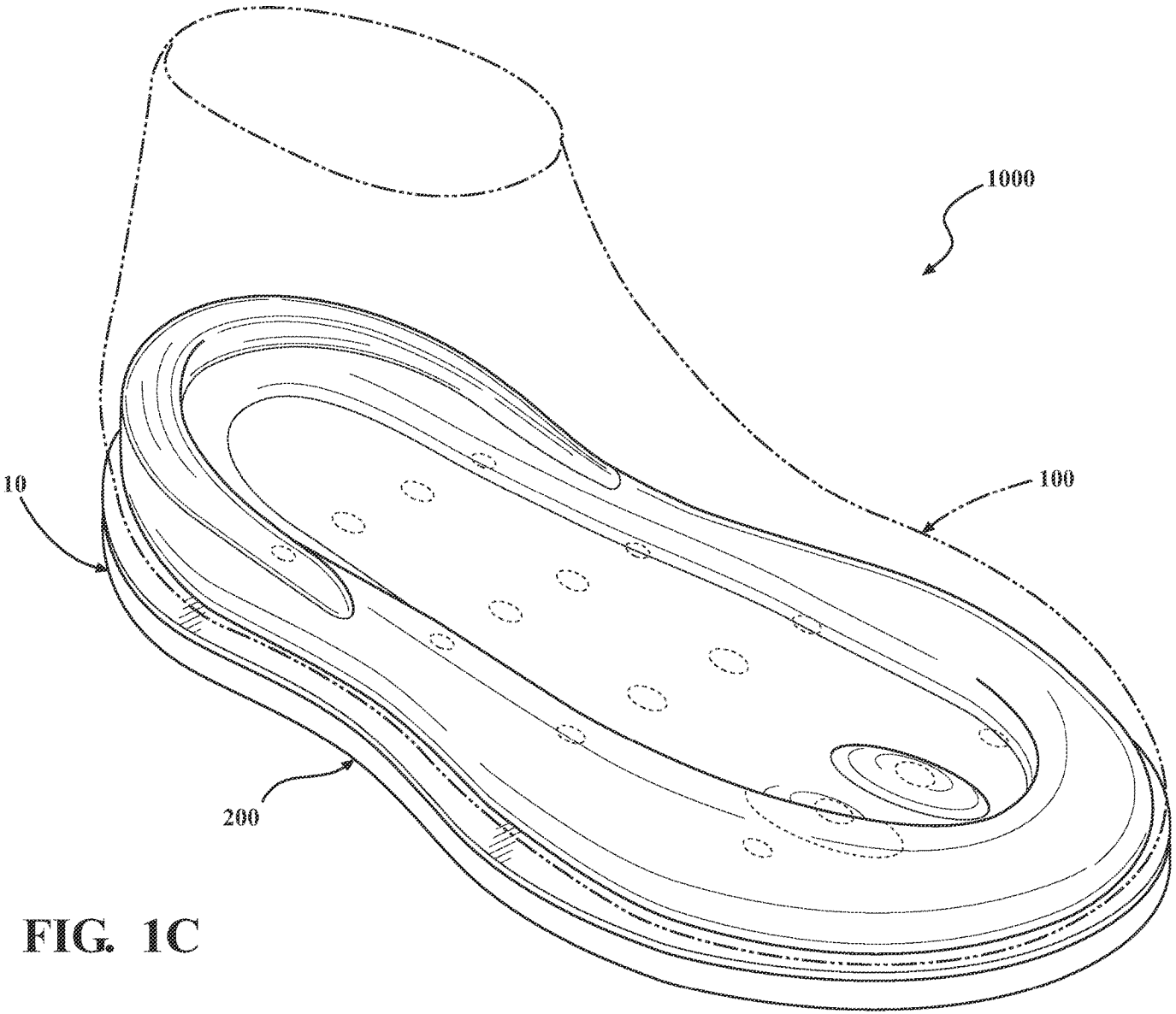
FIG. 1C is a perspective view showing the bladder of FIG. 1A incorporated into an article of footwear.

Referring to FIGS. 1A-1C, a bladder 10 formed according to the principles of the present disclosure is shown. Generally, the bladder 10 includes a first chamber 12*a* formed, at least in part, by a first pair of barrier layers 14*a*, 16*a* on a first side of the bladder 10, and a second chamber 12*b* formed, at least in part, by a second pair of barrier layers 14*b*, 16*b* on an opposite side of the bladder 10 than the first chamber 12*a*. Particularly, the chambers 12*a*, 12*b* are formed on opposite sides of a plate 18, where inner barrier layers or tensile layers 14*a*, 14*b* of each chamber 12*a*, 12*b* are joined to each other through the plate 18, and outer barrier layers 16*a*, 16*b* cooperate with respective ones of the tensile layers 14*a*, 14*b* to form the chambers 12*a*, 12*b*. Thus, as discussed in greater detail below, one or both of the outer barrier layers 16*a*, 16*b* is tethered to the tensile layer 14*b*, 14*a* located on the opposite side of the plate 18 from the respective outer barrier layer 16*a*, 16*b* by the tensile layer 14*a*, 14*b* located on the same side of the plate 18 as the respective outer barrier layer 16*a*, 16*b*.

As illustrated in FIG. 1C, the bladder 10 is formed as a full-length bladder 10 configured to extend continuously from an anterior end to a posterior end of an article of footwear 1000 having an upper 100 and an outsole 200 attached to the bladder 10. As set forth below, the bladder 10 is illustrated with different configurations 10*a*-10*d* in each of a toe region 2, a ball region 3, a mid-foot region 4, and a heel region 5. Particularly, the example bladder 10 shows a first configuration 10*a* (FIGS. 2A-2E) in the toe region 2, a second configuration 10*b* (FIGS. 3A-3E) in the ball region 3, a third configuration 10*c* (FIGS. 4A-4E) in the mid-foot region 4, and a fourth configuration 10*d* (FIGS. 5A-5E) in the heel region 5.

While the configurations 10*a*-10*d* described in each of the regions 2, 3, 4, 5 may all be incorporated into a single bladder 10 in the manner shown and described herein, it will be appreciated that bladders manufactured according to the principles of the present disclosure can include any combination of one or more of the configurations shown in FIG. 1. For example, an entire bladder may be formed using the configuration 10*a* shown and described in FIGS. 2A-2E, or of a combination of the configurations 10*b*, 10*c* shown and described in FIGS. 3A-3E and FIGS. 4A-4E.

Referring now to FIG. 1B, the components of the bladder 10 are shown in an exploded view. As provided above, the bladder includes a plate 18, a pair of tensile layers 14*a*, 14*b* respectively disposed adjacent to opposite sides of the plate 18, and a pair of outer barrier layers 16*a*, 16*b* disposed adjacent to respective ones of the tensile layers 14*a*, 14*b*. Thus, each of the tensile layers 14*a*, 14*b* is interposed between a side of the plate 18 and a respective one of the outer barrier layers 16*a*, 16*b*.

With continued reference to FIG. 1B, the plate 18 includes a first side 20, a second side 22 formed on an opposite side than the first side 20, and an outer periphery 24 extending between the first side 20 and the second side 22. A distance from the first side 20 to the second side 22 defines a thickness of the plate 18. The plate 18 may be described as including a substantially planar interior portion 26, and a peripheral portion 28 formed along the outer periphery 24 of the plate 18 and surrounding the interior region 26. As shown, the plate 18 includes a plurality of apertures 30 formed entirely through the thickness of the plate 18. The apertures 30 may be formed through the interior portion 26 and/or the peripheral portion 28.

In some configurations (10*a*, 10*b*), the thickness of the plate 18 may be substantially constant, while in other configurations (10*c*, 10*d*), the plate 18 may have a variable thickness. Optionally, the peripheral portion 28 defines a peripheral flange 32 extending outwardly from the interior portion 26 at an oblique angle relative to the interior portion 28. Additionally or alternatively, the interior portion 26 and/or the peripheral portion 28 may include protuberances 34 formed on the first side 20 and/or the second side 22 to provide the plate 18 with a variable thickness. In the illustrated example, the plate 18 includes a protuberance 34 formed as a rib 34 extending from the first side 20 of the peripheral flange 32. However, in other examples, the plate 18 may include one or more projections formed in the interior region 26 and/or on the second side 22.

The plate 18 is formed, at least in part, by a material having a greater stiffness than the barrier layers 14*a*, 14*b*, 16*a*, 16*b*, and forms an internal structure or skeleton of the bladder 10. In some examples, the plate 18 includes one or more polymeric materials having a higher melting temperature than at least the tensile layers 14*a*, 14*b*. In other examples, the plate 18 may be formed of or include composite materials and/or metal materials. The first and second sides 20, 22 of the plate 18 are configured to inhibit bonding between the plate 18 and the tensile layers 14*a*, 14*b*. Thus, the plate 18 itself may be formed of a material that is incompatible (i.e., resistant to bonding) with the material of the tensile layers 14*a*, 14*b*. Additionally or alternatively, the sides 20, 22 of the plate 18 may be coated or covered with a bond inhibitor to prevent joining of the tensile layers 14*a*, 14*b* and the plate 18.

With continued reference to FIG. 1B, the tensile layers 14*a*, 14*b* are arranged on opposite sides 20, 22 of the plate 18 such that the plate 18 is interposed between the tensile layers 14*a*, 14*b* when the bladder 10 is assembled. The tensile layers 14*a*, 14*b* each include an inner surface 36*a*, 36*b* and an outer surface 38*a*, 38*b* formed on an opposite side of the tensile layer 14*a*, 14*b* than the inner surface 36*a*, 36*b*. Each of the tensile layers 14*a*, 14*b* includes an outer periphery 40*a*, 40*b* extending between the inner surface 36*a*, 36*b* and the outer surface 38*a*, 38*b*.

When the bladder 10 is assembled, the inner surfaces 36*a*, 36*b* of the tensile layers 14*a*, 14*b* face the plate 18 and are joined to each other by inner bonds 42 through one or more of the apertures 30 of the plate 18. The inner surfaces 36*a*, 36*b* may also be joined to each other along the outer periphery of the plate 18, such that at least a portion of the plate 18 is enclosed between the tensile layers 14*a*, 14*b*.

Referring still to FIG. 1B, the outer barrier layers 16*a*, 16*b* are also arranged on opposite sides 20, 22 of the plate, such that the plate 18 and the tensile layers 14*a*, 14*b* are interposed between the outer barrier layers 16*a*, 16*b*. The outer barrier layers 16*a*, 16*b* each include an inner surface 44*a*, 44*b* and an outer surface 46*a*, 46*b* formed on an opposite side of the outer barrier layer 16*a*, 16*b* from the inner surface 44*a*, 44*b*. Each of the outer barrier layers 16*a*, 16*b* includes an outer periphery 48*a*, 48*b* extending between the inner surface 44*a*, 44*b* and the outer surface 46*a*, 46*b*.

When the bladder 10 is assembled, the inner surfaces 44*a*, 44*b* of the outer barrier layers 16*a*, 16*b* face the outer surfaces 38*a*, 38*b* of the tensile layers 14*a*, 14*b*. As described in greater detail below with respect to each of the configurations 10*a*-10*d*, the inner surfaces 44*a*, 44*b* of the outer barrier layers 16*a*, 16*b* may be joined to the outer surfaces 38*a*, 38*b* of the tensile layers 14*a*, 14*b*, respectively, to define a geometry (e.g., thicknesses, width, and lengths) of the bladder 10. For example, the inner surfaces 44*a*, 44*b* of the outer barrier layers 16*a*, 16*b* may be joined to the outer surfaces 38*a*, 38*b* of the tensile layers 14*a*, 14*b* by a plurality of outer bonds 50 in the interior portion 26 to form first and second web areas 52*a*, 52*b* of the bladder 10. Similarly, the outer peripheries of the barrier layers 14*a*, 14*b*, 16*a*, 16*b* may be joined together to form a peripheral seam 54 extending around the bladder 10 to seal the fluid (e.g., air) within the fluid-filled chamber chambers 12*a*, 12*b*. Thus, the chambers 12*a*, 12*b* are associated with areas of the bladder 10 where the inner surfaces 44*a*, 44*b* of the outer barrier layers 16*a*, 16*b* are not joined together and, therefore, are separated from the outer surfaces 38*a*, 38*b* of the tensile layers 14*a*, 14*b*. As shown in the figures, a space formed between opposing surfaces 38*a*, 38*b*, 44*a*, 44*b* of the tensile layers 14*a*, 14*b* and outer barrier layers 16*a*, 16*b* defines an interior void 56*a*, 56*b* of each of the chambers 12*a*, 12*b*.

The barrier layers 14*a*, 14*b*, 16*a*, 16*b* can each be produced from an elastomeric material that includes one or more thermoplastic polymers and/or one or more cross-linkable polymers. In an aspect, the elastomeric material can include one or more thermoplastic elastomeric materials, such as one or more thermoplastic polyurethane (TPU) copolymers, one or more ethylene-vinyl alcohol (EVOH) copolymers, and the like. The tensile layers 14*a*, 14*b* are formed of a first elastomeric material and the outer barrier layers 16*a*, 16*b* are formed of a second elastomeric material.

The first elastomeric material is selected with a first melting temperature suitable for allowing the tensile layers 14*a*, 14*b* to be melded to each other through the plate 18 without affecting the material properties of the plate 18. For instance, the first melting temperature of the first elastomeric material is low enough that the plate 18 will not be melted, deformed, or weakened when subjected to the first melting temperature during assembly of the bladder 10. Accordingly, elastomeric material having different melting temperatures can be selected as the tensile layer 14*a*, 14*b* depending on the material of the plate 18 (e.g., polymeric, composite, metal). In some examples, where the plate 18 is formed of a polymeric material having a relatively low melting point (compared to metals or composites), the first elastomeric material may be a low-melt TPU having a melting temperature that is less than a melting temperature of the material of the plate 18.

The second elastomeric material of the outer barrier layers 16*a*, 16*b* may be different than the first elastomeric material of the tensile layers 14*a*, 14*b*. For example, where a low-melt TPU material is utilized as the first elastomeric material, a conventional TPU material having a higher melting temperature may be utilized as the second elastomeric material. Utilizing a conventional TPU having a higher melting temperature for the second elastomeric material provides the outer barrier layers 16*a*, 16*b* of the chambers 12*a*, 12*b* with improved durability.

One or more of the barrier layers 14*a*, 14*b*, 16*a*, 16*b* can independently be transparent, translucent, and/or opaque. As used herein, the term "transparent" for a barrier layer and/or a fluid-filled chamber means that light passes through the barrier layer in substantially straight lines and a viewer can see through the barrier layer. In comparison, for an opaque barrier layer, light does not pass through the barrier layer and one cannot see clearly through the barrier layer at all. A translucent barrier layer falls between a transparent barrier layer and an opaque barrier layer, in that light passes through a translucent layer but some of the light is scattered so that a viewer cannot see clearly through the layer.

As used herein, the term "barrier layer" (e.g., barrier layers 14*a*, 14*b*, 16*a*, 16*b*) encompasses both monolayer and multilayer films. In some embodiments, one or more of the barrier layers 14*a*, 14*b*, 16*a*, 16*b* is produced (e.g., thermoformed or blow molded) from a monolayer film (a single layer). In other embodiments, one or more of the barrier layers 14*a*, 14*b*, 16*a*, 16*b* is produced (e.g., thermoformed or blow molded) from a multilayer film (multiple sublayers). In either aspect, each layer or sublayer can have a film thickness ranging from about 0.2 micrometers to about be about 1 millimeter. In further embodiments, the film thickness for each layer or sublayer can range from about 0.5 micrometers to about 500 micrometers. In yet further embodiments, the film thickness for each layer or sublayer can range from about 1 micrometer to about 100 micrometers.

As used herein, "polyurethane" refers to a copolymer (including oligomers) that contains a urethane group (—N(C═O)O—). These polyurethanes can contain additional groups such as ester, ether, urea, allophanate, biuret, carbodiimide, oxazolidinyl, isocynaurate, uretdione, carbonate, and the like, in addition to urethane groups. In an aspect, one or more of the polyurethanes can be produced by polymerizing one or more isocyanates with one or more polyols to produce copolymer chains having (—N(C═O)O—) linkages.

Examples of suitable isocyanates for producing the polyurethane copolymer chains include diisocyanates, such as aromatic diisocyanates, aliphatic diisocyanates, and combinations thereof. Examples of suitable aromatic diisocyanates include toluene diisocyanate (TDI), TDI adducts with trimethyloylpropane (TMP), methylene diphenyl diisocyanate (MDI), xylene diisocyanate (XDI), tetramethylxylylene diisocyanate (TMXDI), hydrogenated xylene diisocyanate (HXDI), naphthalene 1,5-diisocyanate (NDI), 1,5-tetrahydronaphthalene diisocyanate, para-phenylene diisocyanate (PPDI), 3,3'-dimethyldiphenyl-4, 4'-diisocyanate (DDDI), 4,4'-dibenzyl diisocyanate (DBDI), 4-chloro-1,3-phenylene diisocyanate, and combinations thereof. In some embodiments, the copolymer chains are substantially free of aromatic groups.

In particular aspects, the polyurethane polymer chains are produced from diisocynates including HMDI, TDI, MDI, H12 aliphatics, and combinations thereof. In an aspect, the thermoplastic TPU can include polyester-based TPU, polyether-based TPU, polycaprolactone-based TPU, polycarbonate-based TPU, polysiloxane-based TPU, or combinations thereof.

In another aspect, the polymeric layer can be formed of one or more of the following: EVOH copolymers, poly (vinyl chloride), polyvinylidene polymers and copolymers (e.g., polyvinylidene chloride), polyamides (e.g., amorphous polyamides), amide-based copolymers, acrylonitrile polymers (e.g., acrylonitrile-methyl acrylate copolymers), polyethylene terephthalate, polyether imides, polyacrylic imides, and other polymeric materials known to have relatively low gas transmission rates. Blends of these materials, as well as with the TPU copolymers described herein and optionally including combinations of polyimides and crystalline polymers, are also suitable.

The barrier layers 14*a*, 14*b*, 16*a*, 16*b* may include two or more sublayers (multilayer film) such as shown in Mitchell et al., U.S. Pat. No. 5,713,141 and Mitchell et al., U.S. Pat. No. 5,952,065, the disclosures of which are incorporated by reference in their entirety. In embodiments where the barrier layers 14*a*, 14*b*, 16*a*, 16*b* include two or more sublayers, examples of suitable multilayer films include microlayer films, such as those disclosed in Bonk et al., U.S. Pat. No. 6,582,786, which is incorporated by reference in its entirety. In further embodiments, the barrier layers 14*a*, 14*b*, 16*a*, 16*b* may each independently include alternating sublayers of one or more TPU copolymer materials and one or more EVOH copolymer materials, where the total number of sublayers in each of the barrier layers 14*a*, 14*b*, 16*a*, 16*b* includes at least four (4) sublayers, at least ten (10) sublayers, at least twenty (20) sublayers, at least forty (40) sublayers, and/or at least sixty (60) sublayers.

The bladder 10 can be produced from the barrier layers 14*a*, 14*b*, 16*a*, 16*b* using any suitable technique, such as thermoforming (e.g. vacuum thermoforming), blow molding, extrusion, injection molding, vacuum molding, rotary molding, transfer molding, pressure forming, heat sealing, casting, low-pressure casting, spin casting, reaction injection molding, radio frequency (RF) welding, and the like. In an aspect, the barrier layers 14*a*, 14*b*, 16*a*, 16*b* can be produced by co-extrusion followed by vacuum thermoforming to produce an inflatable chamber 12*a*, 12*b*, which can optionally include one or more valves (e.g., one way valves) that allows the chamber 12*a*, 12*b* to be filled with the fluid (e.g., gas).

The chambers 12*a*, 12*b* can be provided in a fluid-filled (e.g., as provided in bladder 10) or in an unfilled state. The chambers 12*a*, 12*b* can be filled to include any suitable fluid, such as a gas or liquid. In an aspect, the gas can include air, nitrogen ($N_2$), or any other suitable gas. In other aspects, the chambers 12*a*, 12*b* can alternatively include other media, such as pellets, beads, ground recycled material, and the like (e.g., foamed beads and/or rubber beads). The fluid provided to the chambers 12*a*, 12*b* can result in the chambers 12*a*, 12*b* being pressurized. Alternatively, the fluid provided to the chambers 12*a*, 12*b* can be at atmospheric pressure such that the chambers 12*a*, 12*b* are not pressurized but, rather, simply contain a volume of fluid at atmospheric pressure.

The chambers 12*a*, 12*b* desirably have a low gas transmission rate to preserve its retained gas pressure. In some embodiments, the chambers 12*a*, 12*b* have a gas transmission rate for nitrogen gas that is at least about ten (10) times lower than a nitrogen gas transmission rate for a butyl rubber layer of substantially the same dimensions. In an aspect, the chambers 12*a*, 12*b* have a nitrogen gas transmission rate of 15 cubic-centimeter/square-meter·atmosphere·day ($cm^3/m^2 \cdot atm \cdot day$) or less for an average film thickness of 500 micrometers (based on thicknesses of barrier layers 14*a*,

14*b*, 16*a*, 16*b*). In further aspects, the transmission rate is 10 $cm^3/m^2 \cdot atm \cdot day$ or less, 5 $cm^3/m^2 \cdot atm \cdot day$ or less, or 1 $cm^3/m^2 \cdot atm \cdot day$ or less.

Turning now to FIGS. 2A-5E, systems 100*a*-100*d* and methods for forming the different configurations 10*a*-10*d* of the bladder 10 are shown. As discussed above, the different configurations 10*a*-10*d* are illustrated in distinct regions 2-5 of a single bladder 10. However, one or more of the configurations 10*a*-10*d* may be utilized in any region of the bladder 10, and/or the entire bladder 10 may be formed using a single one of the configurations 10*a*-10*d*.

Figure 2A:
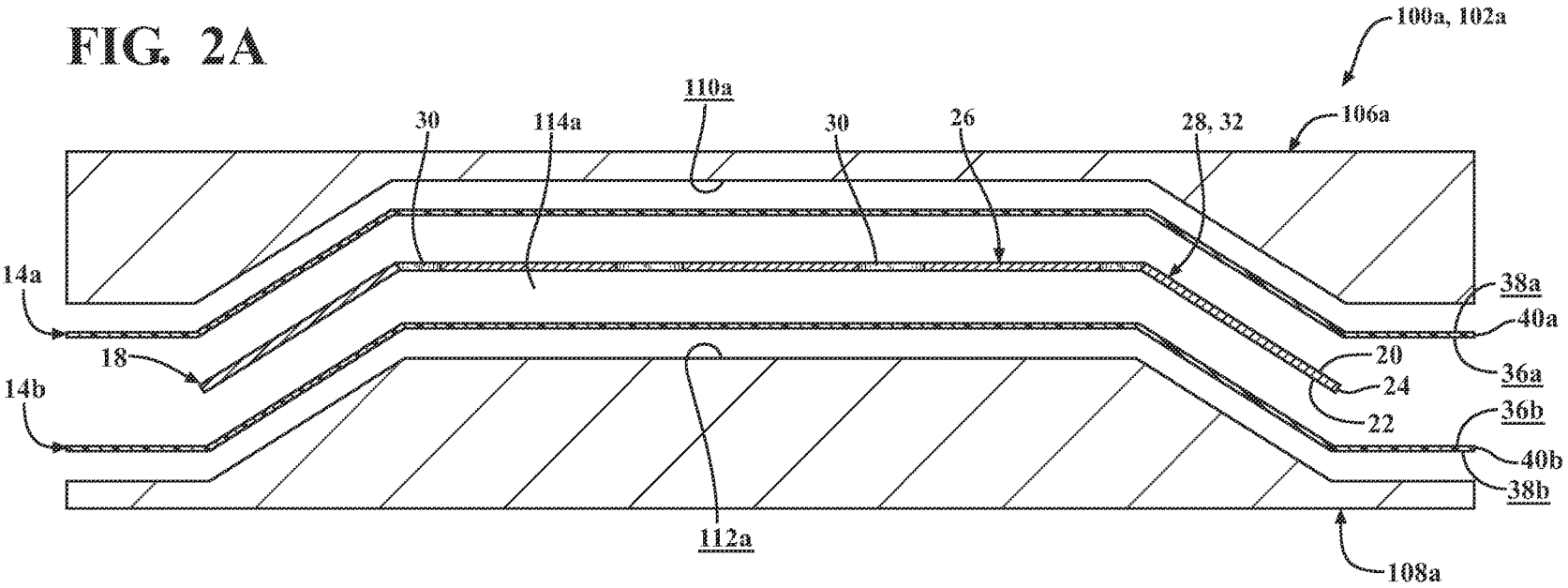
FIGS. 2A-2E are partial environmental views of a system and method for forming a configuration of a bladder in accordance with principles of the present disclosure.
Figure 2B:
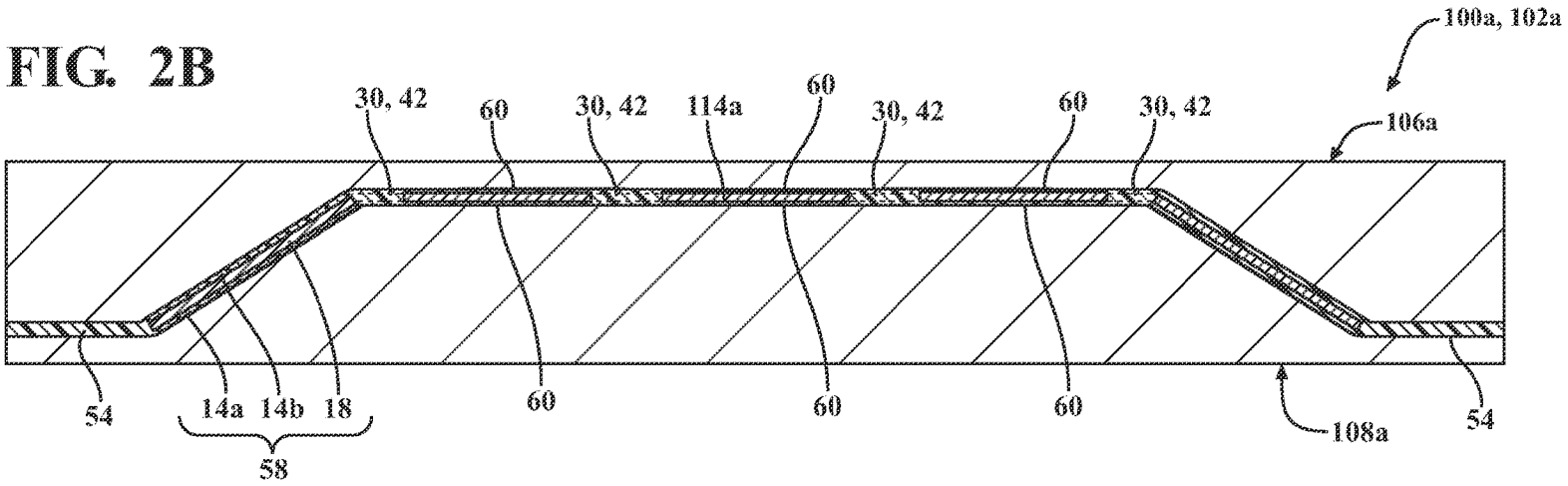
Figure 2C:
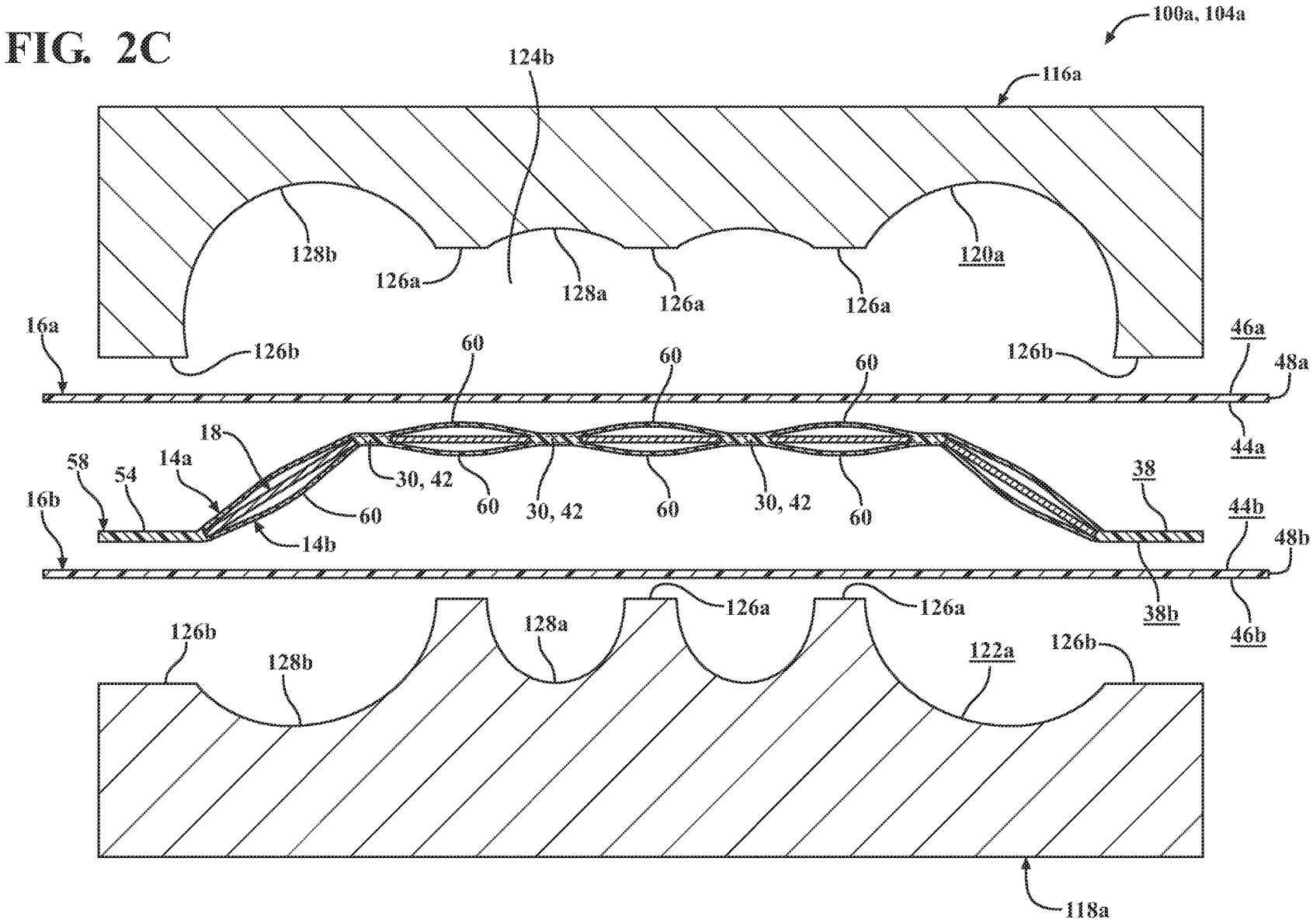
Figure 2D:
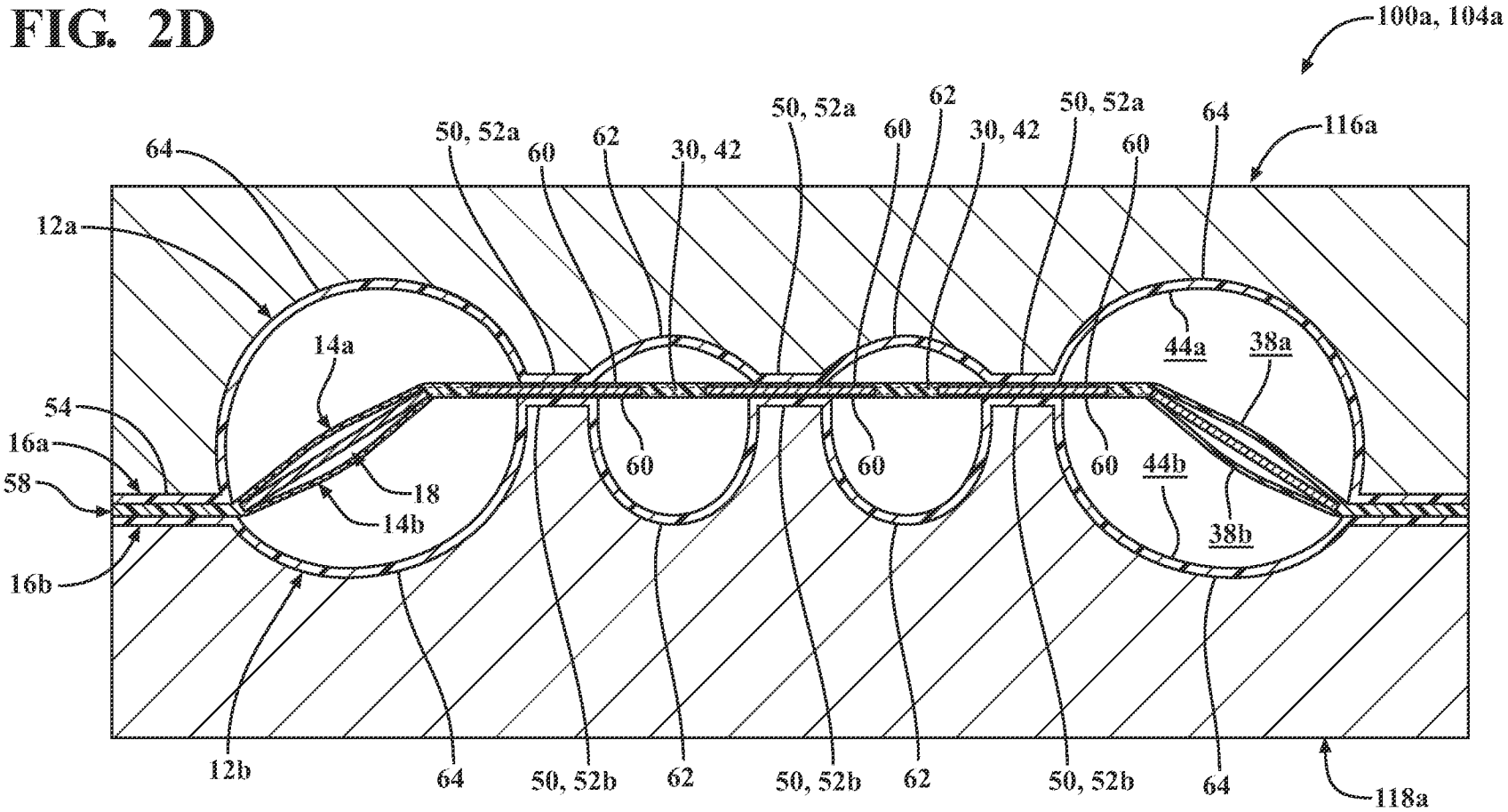

With reference to FIGS. 2A-2E, a system 100*a* and method for forming the first configuration 10*a* of the bladder 10 are shown. As, shown, the system includes a first tool 102*a* (FIGS. 2A and 2B) and a second tool 104*a* (FIGS. 2C and 2D). The first tool 102*a* includes an upper mold 106*a* and a lower mold 108*a* each including a respective mold surface 110*a*, 112*a*. As shown, the upper and lower mold surfaces 110*a*, 112*a* face each other, and cooperate to define a mold cavity 114*a* for receiving each of the tensile layers 14*a*, 14*b* and the plate 18. Accordingly, profiles of the mold surfaces 110*a*, 112*a* correspond to profiles of the first and second sides 20, 22 of the plate 18. As illustrated in FIG. 2A, the plate 18 and the tensile layers 14*a*, 14*b* are initially provided to the mold cavity 114*a* in a layered arrangement with the plate 18 disposed between the tensile layers 14*a*, 14*b*.

With the components 14*a*, 14*b*, 18 positioned within the mold cavity 114*a*, the first tool 102*a* is then moved to a closed position (FIG. 2B) to join the inner surfaces 36*a*, 36*b* of the first tensile layer 14*a* and the second tensile layer 14*b* together through and around the plate 18. Particularly, the inner surfaces 36*a*, 36*b* of the tensile layers 14*a*, 14*b* are joined together within the apertures 30 of the plate 18 at respective inner bonds 42. Similarly, the outer peripheries 40*a*, 40*b* of the tensile layers 14*a*, 14*b* may be at least partially joined to each other around the outer periphery 24 of the plate 18 to form a first portion of the peripheral seam 54. Here, the plate 18 is at least partially encapsulated within the joined tensile layers 14*a*, 14*b*, such that the components 14*a*, 14*b*, 18 may be collectively referred to as forming a chassis 58 for incorporation within the bladder 10.

The first tool 102*a* may be a thermoforming tool 102*a* configured to subject the components 14*a*, 14*b*, 18 to a combination of heat and pressure to join the tensile layers 14*a*, 14*b* together. However, in other examples, the tensile layers 14*a*, 14*b* may be chemically attached (e.g., adhesives) or may be joined together using ultrasonic welding. As discussed above, the sides 20, 22 of the plate 18 are inhibited from bonding to the tensile layers 14*a*, 14*b* by forming the plate 18 of an incompatible material or by coating the sides 20, 22 with a bond inhibitor. For example, where thermoforming (melding) is used, the plate 18 may have a higher melting temperature than the tensile layers 14*a*, 14*b* to prevent melding between the plate 18 and the tensile layers 14*a*, 14*b* at the melting temperature of the tensile layers 14*a*, 14*b*. In other examples, a chemical coating may prevent adhesion, or a mechanical barrier may prevent attachment. Thus, while the tensile layers 14*a*, 14*b* may be compressed directly or indirectly against the plate 18 during the second step (FIG. 2B), the tensile layers 14*a*, 14*b* will only bond to each other and will remain detached from the plate 18 at areas between the inner bonds 42 and the peripheral seam 54.

Turning now to FIG. 2C, the chassis 58 is shown after removal from the first tool 102*a*. Here, the tensile layers 14*a*, 14*b* are attached to each other through and around the plate 18, and are detached from the plate 18 between the inner bonds 42 and the peripheral seam 54. These detached portions of the tensile layers 14*a*, 14*b* form tensile elements 60 of the chassis 58, which, as described below, are ultimately attached to the outer barrier layers 16*a*, 16*b* to tether the outer barrier layers 16*a*, 16*b* to the chassis 58.

At FIG. 2C, the chassis 58 and the outer barrier layers 16*a*, 16*b* are positioned within the second tool 104*a*. The second tool 104*a* includes an upper mold 116*a* and a lower mold 118*a* each including a respective mold surface 120*a*, 122*a*. As shown, the upper and lower mold surfaces 120*a*, 122*a* face each other, and cooperate to define a mold cavity 124*a* for receiving each of the outer barrier layers 16*a*, 16*b* and the chassis 58. As illustrated in FIG. 2C, the plate 18 and the outer barrier layers 16*a*, 16*b* are initially provided to the mold cavity 124*a* in a layered arrangement with the chassis 58 disposed between the outer barrier layers 16*a*, 16*b*.

The profiles of the mold surfaces 120*a*, 122*a* of the second tool 104*a* respectively define the shapes of the first and second chambers 12*a*, 12*b* in the first configuration 10*a* of the bladder 10. For instance, the mold surfaces 120*a*, 122*a* each include interior projections 126*a* corresponding to the web areas 52*a*, 52*b* and peripheral projections 126*b* corresponding to the peripheral seam 54. The interior projections 126*a* of each mold surface 120*a*, 122*a* are aligned with the tensile elements 60 of the chassis 58, between the inner bonds 42. Thus, as discussed below, the interior projections 126*a* are configured to compress the outer barrier layers 16*a*, 16*b* against the tensile elements 60 formed by the tensile layers 14*a*, 14*b*. The peripheral projections 126*b* are positioned outwardly from the outer periphery 24 of the plate 18, and are configured to compress the outer peripheries 48*a*, 48*b* of the outer layers 16*a*, 16*b* against the first portion of the peripheral seam 54 formed by the tensile layers 14*a*, 14*b*.

The mold surfaces 120*a*, 122*a* also include recesses 128*a*, 128*b* formed between the projections 126*a*, 126*b*, which correspond to the shapes of the chambers 12*a*, 12*b*. In the illustrated example, the upper and lower mold surfaces 120*a*, 122*a* each include interior recesses 128*a* corresponding to interior subchambers 62 and peripheral recesses 128*b* corresponding to peripheral subchambers 64. Here, the interior recesses 126*a* of the upper mold 116*a* are shallower than the interior recesses 126*a* of the lower mold 118*a*, whereby the interior recesses 126*a* of the upper mold 116*a* form interior subchambers 62 in the first chamber 12*a* that have a lesser height than the interior subchambers 62 of the second chamber 12*b*.

Turning now to FIG. 2D, with the outer barrier layers 16*a*, 16*b* and the chassis 58 positioned within the mold cavity 124*a*, the second tool 104*a* is moved to the closed position. The second tool 104*a* may be configured as a vacuum forming tool 104*a*, which imparts a vacuum within the mold cavity 124*a* to draw each of the outer barrier layers 16*a*, 16*b* against the respective mold surface 120*a*, 122*a*, thereby forming the profile of each chamber 12*a*, 12*b*.

In the closed position, the interior projections 126*a* and the peripheral projections 126*b* of each mold 116*a*, 118*a* are aligned with each other across the barrier layers 16*a*, 16*b* and the chassis 58, such that the barrier layers 16*a*, 16*b* and the chassis 58 are compressed between opposing (i.e., facing) distal ends of corresponding projections 126*a*, 126*b*. As shown, the interior projections 126*a* of each mold 116*a*, 118*a* are aligned with each other across the tensile elements 60 of the chassis 58 to form a first plurality of the outer bonds 50 between the first interior barrier layer 14*a* and the first outer barrier layer 16*a* on the first side 20 of the plate 18, and a second plurality of the outer bonds 50 between the second tensile layer 14*b* and the second outer barrier layer 16*b* on the second side 22 of the plate 18. The peripheral projections 126*b* are aligned with each other across the portion of the peripheral seam 54 formed by the tensile layers 14*a*, 14*b*, and are configured to compress the outer barrier layers 16*a*, 16*b* against the tensile layers 14*a*, 14*b* to join the outer barrier layers 16*a*, 16*b* to the peripheral seam 54.

Figure 2E:
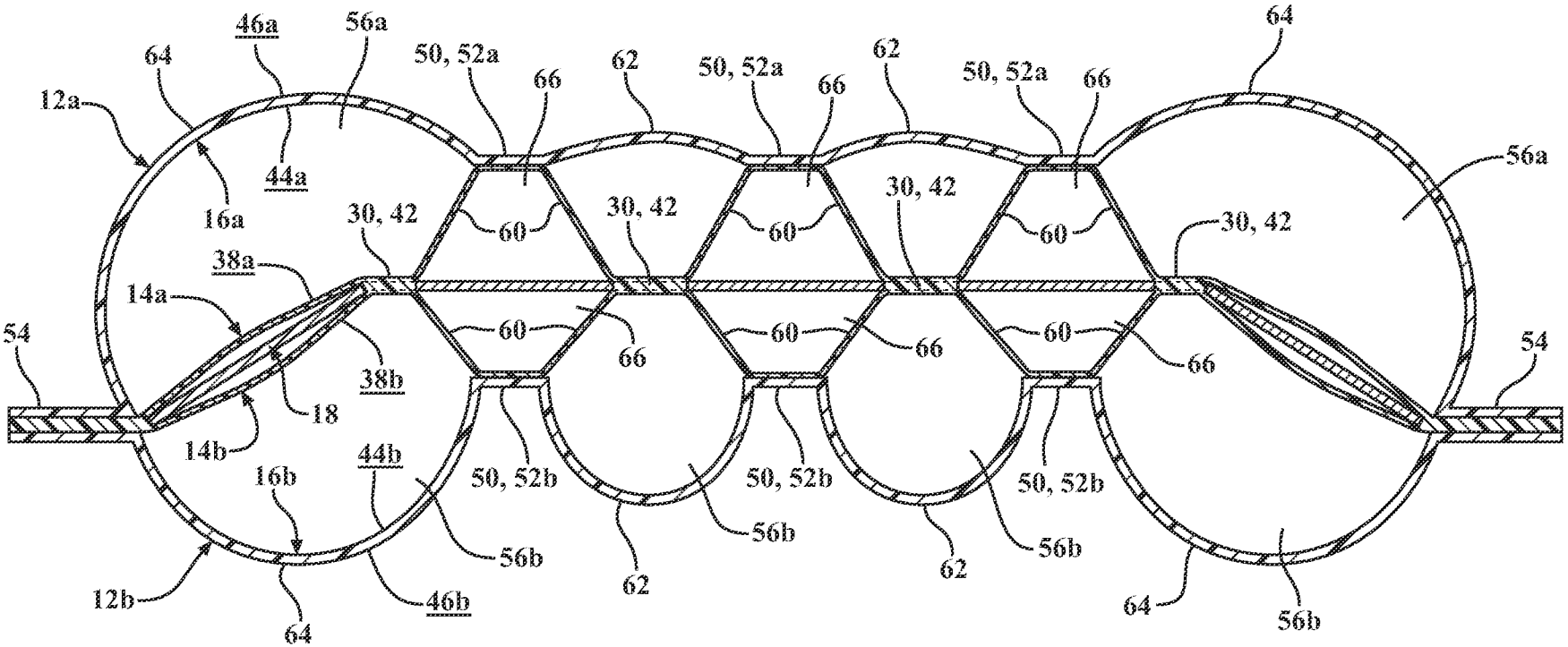

With the outer barrier layers 16*a*, 16*b* joined to the tensile layers 14*a*, 14*b* at the outer bonds 50 and the peripheral seam 54, the bladder 10 can be removed from the second tool 104*a*, as shown in FIG. 2E. Optionally, the interior voids 56*a*, 56*b* of the first chamber 12*a* and the second chamber 12*b* may be pressurized prior to or following removal of the bladder 10 from the second tool 104*a*. As a reminder, the interior voids 56*a*, 56*b* are formed between respective pairs of the tensile layers 14*a*, 14*b* and the outer barrier layers 16*a*, 16*b*. Thus, upon pressurization, the portions of the outer barrier layers 16*a*, 16*b* extending between the outer bonds 50 and the peripheral seam 54 are biased apart from the respective tensile layers 14*a*, 14*b* to form the interior voids 56*a*, 56*b*.

As shown and discussed above, the different profiles imparted to the outer barrier layers 16*a*, 16*b* during the vacuum forming process result in the first chamber 12*a* and the second chamber 12*b* having different profiles. Additionally, the interior voids 56*a*, 56*b* of the chambers 12*a*, 12*b* may be provided with different pressures. For instance, the interior void 56*a* of the first chamber 12*a* may have a greater pressure than the interior void 56*b* of the second chamber 12*b*, or vice versa. Optionally, spaces 66 formed between the tensile elements 60 and the plate 18 may also be pressurized with same or different pressures than the pressures of the interior voids 56*a*, 56*b*.

With particular reference to FIGS. 3A-3E, a system 100*b* and method for forming the second configuration 10*b* of the bladder 10 are shown. In view of the substantial similarity in structure and function of the components associated with the system 100*a* and configuration 10*a* with respect to the system 100*b* and configuration 10*b*, like reference numerals are used hereinafter and in the drawings to identify like components while like reference numerals containing letter extensions are used to identify those components that have been modified.

Figure 3A:
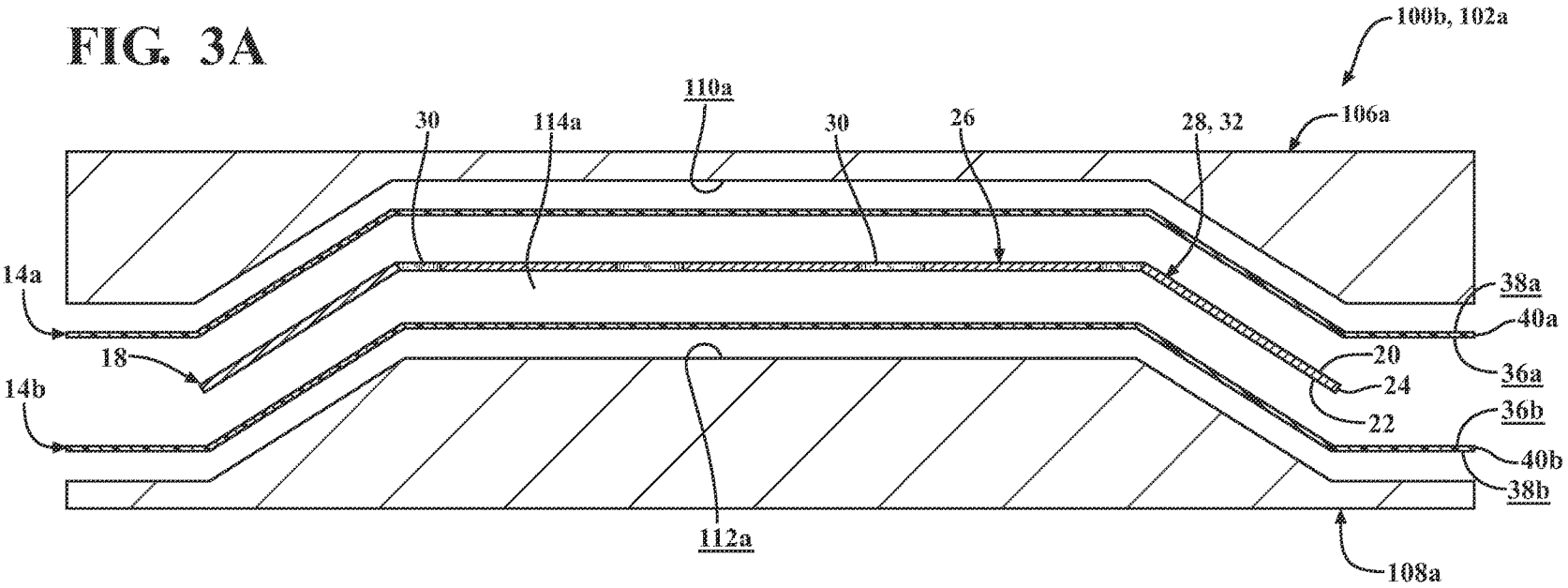
FIGS. 3A-3E are partial environmental views of a system and method for forming a configuration of a bladder in accordance with principles of the present disclosure.
Figure 3B:
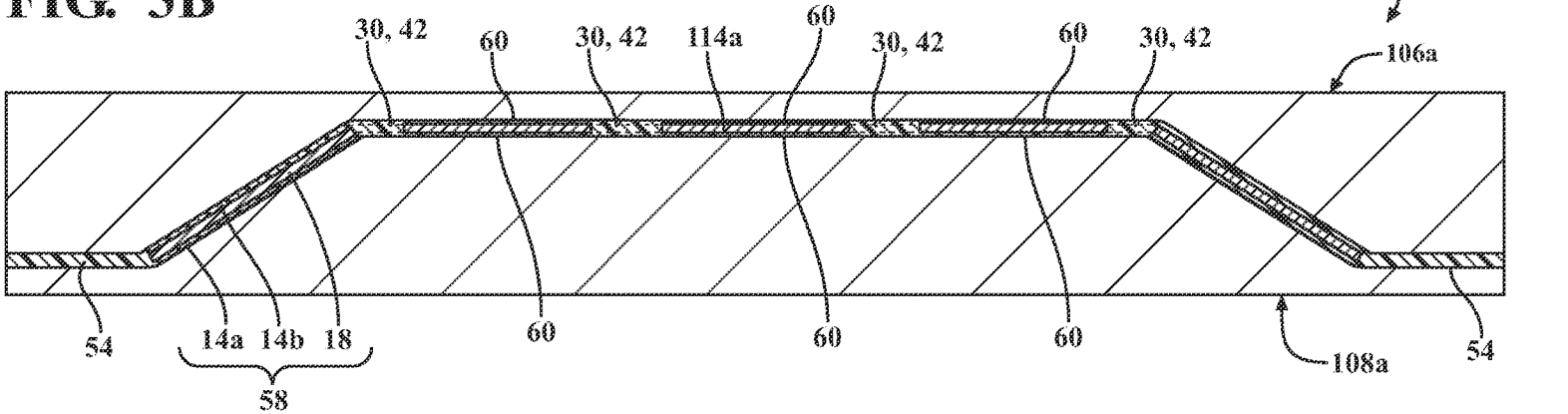
Figure 3C:
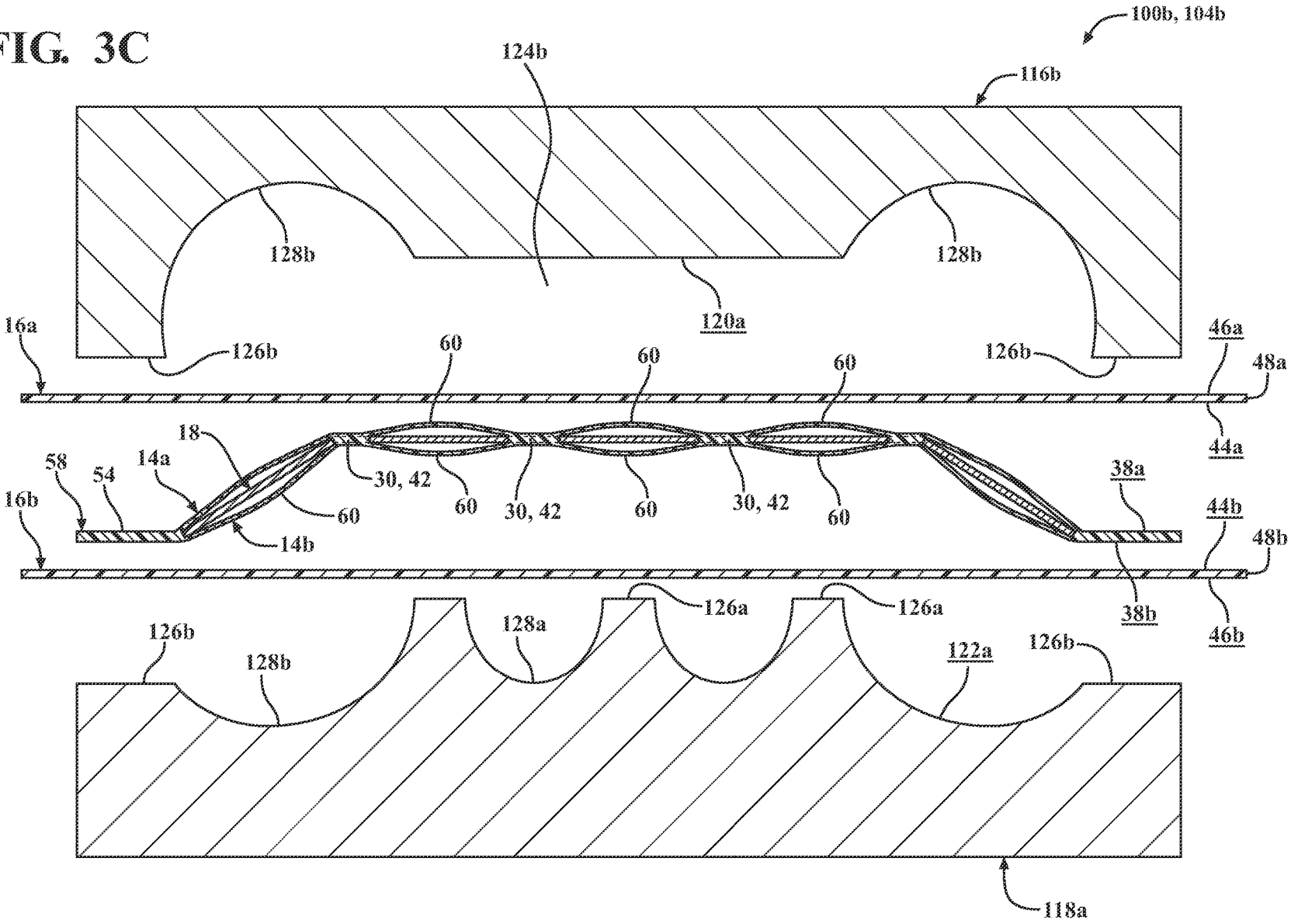

As shown in FIGS. 3A and 3B, formation of the second configuration 10*b* of the bladder 10 includes initially forming the chassis 58 using the first tool 102*a* in the same manner as described above with respect to FIGS. 2A and 2B. The chassis 58 and the outer barrier layers 16*a*, 16*b* are then positioned within a second tool 104*b* for forming the bladder 10, as shown in FIG. 3C. Here, the second tool 104*b* is substantially similar to the second tool 104*a* described above, except that the upper mold surface 120*b* of the upper mold 116*b* has a topography corresponding to a topography of the first side 20 of the interior portion 26 of the plate 18. Thus, the upper mold surface 120*b* is generally configured to compress the first outer barrier layer 16*a* and the first tensile layer 14*a* together against the first side 20 of the plate 18 and between the inner bonds 42. In this particular example, each of the first side 22 of the plate 18 and the upper mold surface 120*b* are shown as being planar. Accordingly, the planar upper mold surface 120*b* compresses the first outer barrier layer 16*a* and the first tensile layer 14*a* together against the planar interior portion 26 of the plate 18. However, in other examples, the interior portion 26 of the plate 18 may be contoured, and the upper mold surface 120*b* may have a corresponding or complementary contour.

Figure 3D:
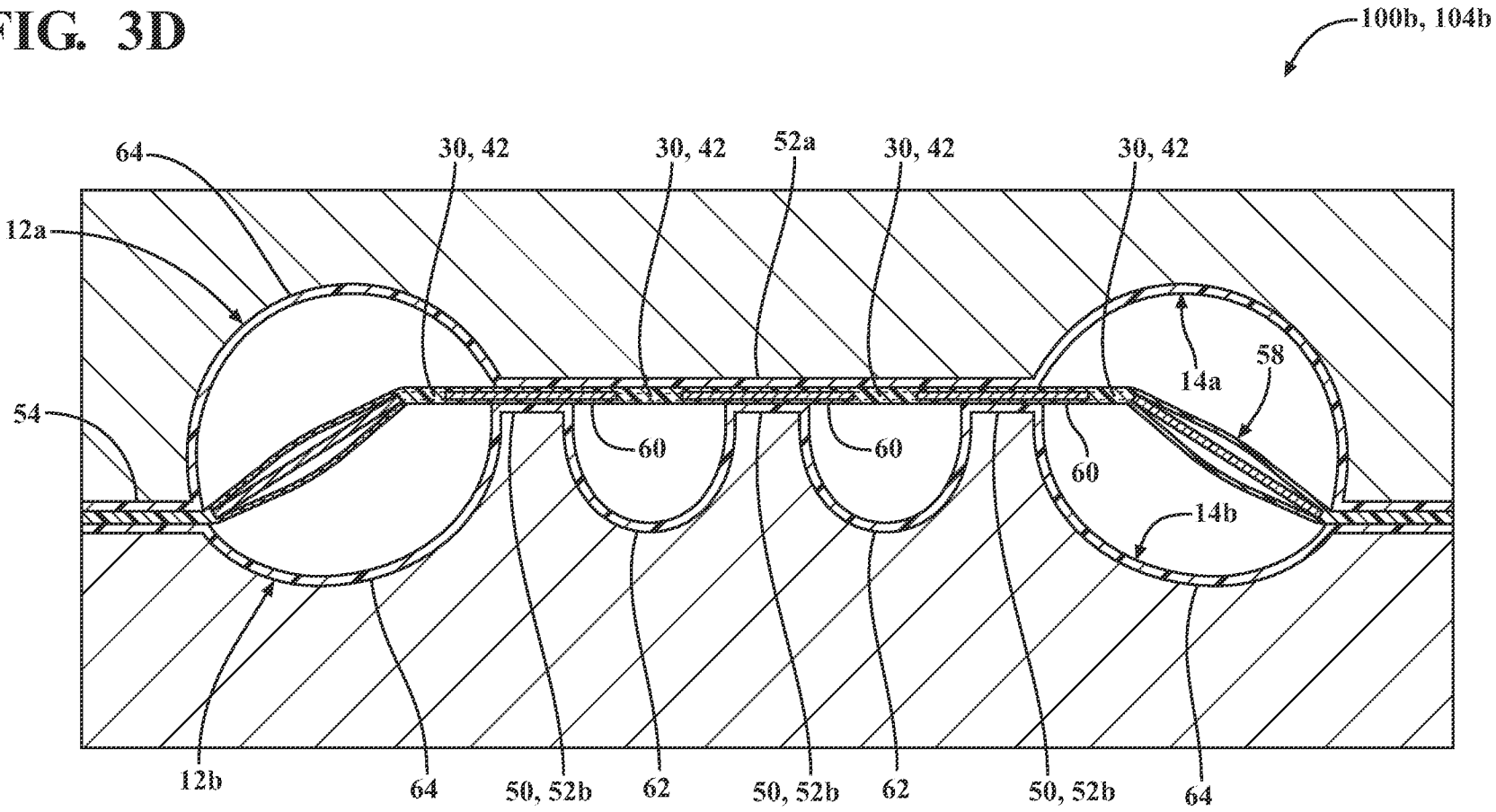

Referring to FIG. 3D, when the system 100*b* is moved to the closed position, the planar portion of the upper mold surface 120*b* compresses the first outer barrier layer 16*a* against the first tensile layer 14*a* across the interior portion 26 of the plate 18 and the first outer barrier layer 16*a* is joined to the first tensile layer 14*a* in the compressed areas. Accordingly, not only is the first outer barrier layer 16*a* joined to the first tensile layer 14*a* along the tensile elements 60, but the barrier layers 14*a*, 16*a* are also joined together across the first bonds 42 between the tensile layers 14*a*, 14*b*. Accordingly, in the second configuration 10*b*, the web area 52*a* of first chamber 12*a* extends continuously across at least one of the inner bonds 42, as opposed to only extending between the inner bonds 42, as was done in the first configuration. In the illustrated example, the web area 52*a* of the first chamber 12*a* is shown as extending across two of the inner bonds 42.

Figure 3E:
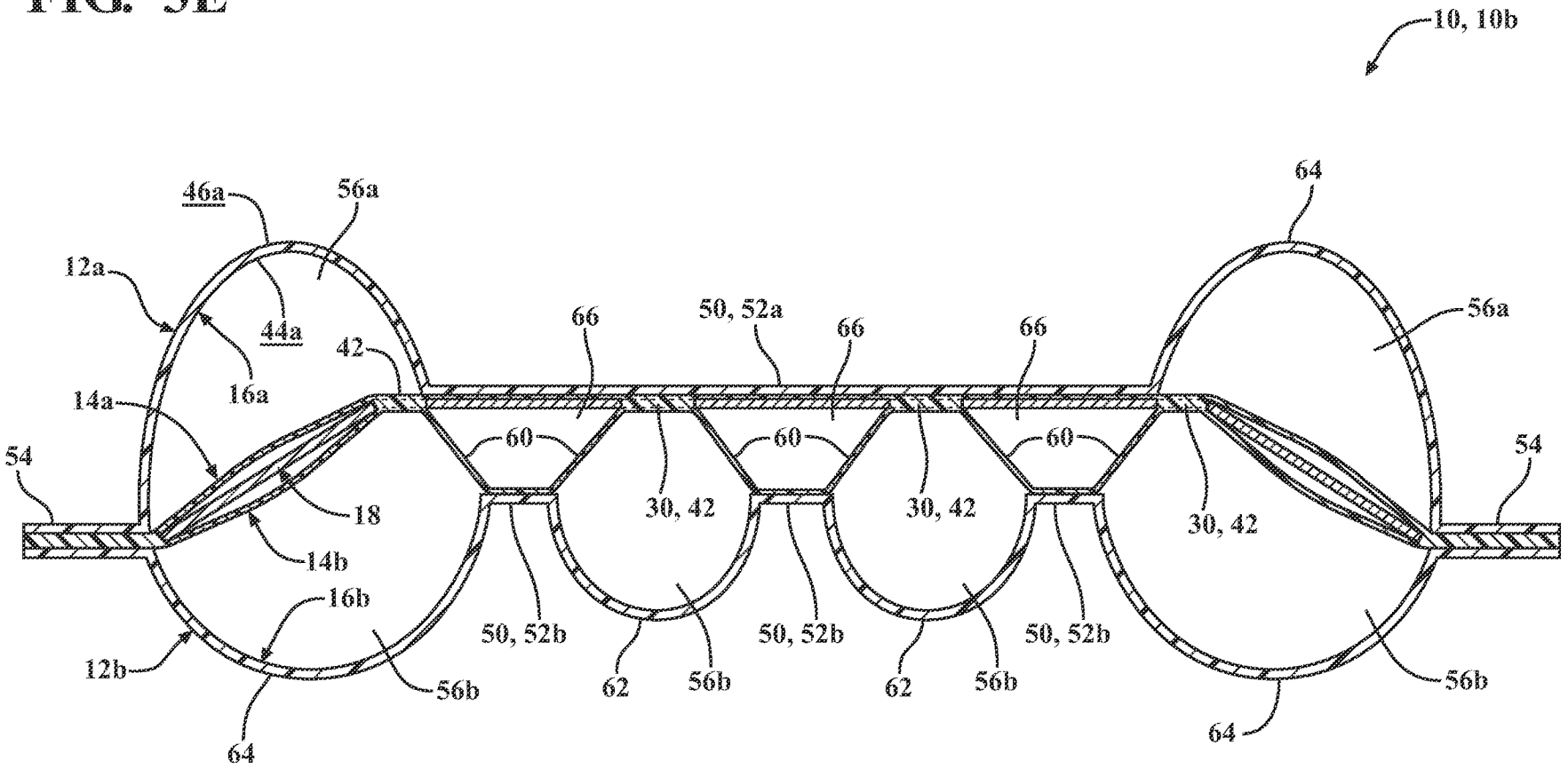

Turning to FIG. 3E, when the first chamber 12*a* is inflated, no interior subchambers are formed in the first chamber 12*a*, as the first outer barrier layer 16*a* is continuously joined to the first tensile layer 14*a* along the interior portion 26 of the plate 18. As shown, the first chamber 12*a* only includes the peripheral subchambers 64. Here, the second chamber 12*b* is formed the same as described above with respect to the first configuration 10*a*, and includes interior subchambers 62 and the peripheral subchambers 64. Again, the first chamber 12*a* and the second chamber 12*b* may have the same or different pressures.

With particular reference to FIGS. 4A-4E, a system 100*c* and method for forming the third configuration 10*c* of the bladder 10 are shown. In view of the substantial similarity in structure and function of the components associated with the system 100*a* and configuration 10*a* with respect to the system 100*c* and configuration 10*c*, like reference numerals are used hereinafter and in the drawings to identify like components while like reference numerals containing letter extensions are used to identify those components that have been modified.

Figure 4A:
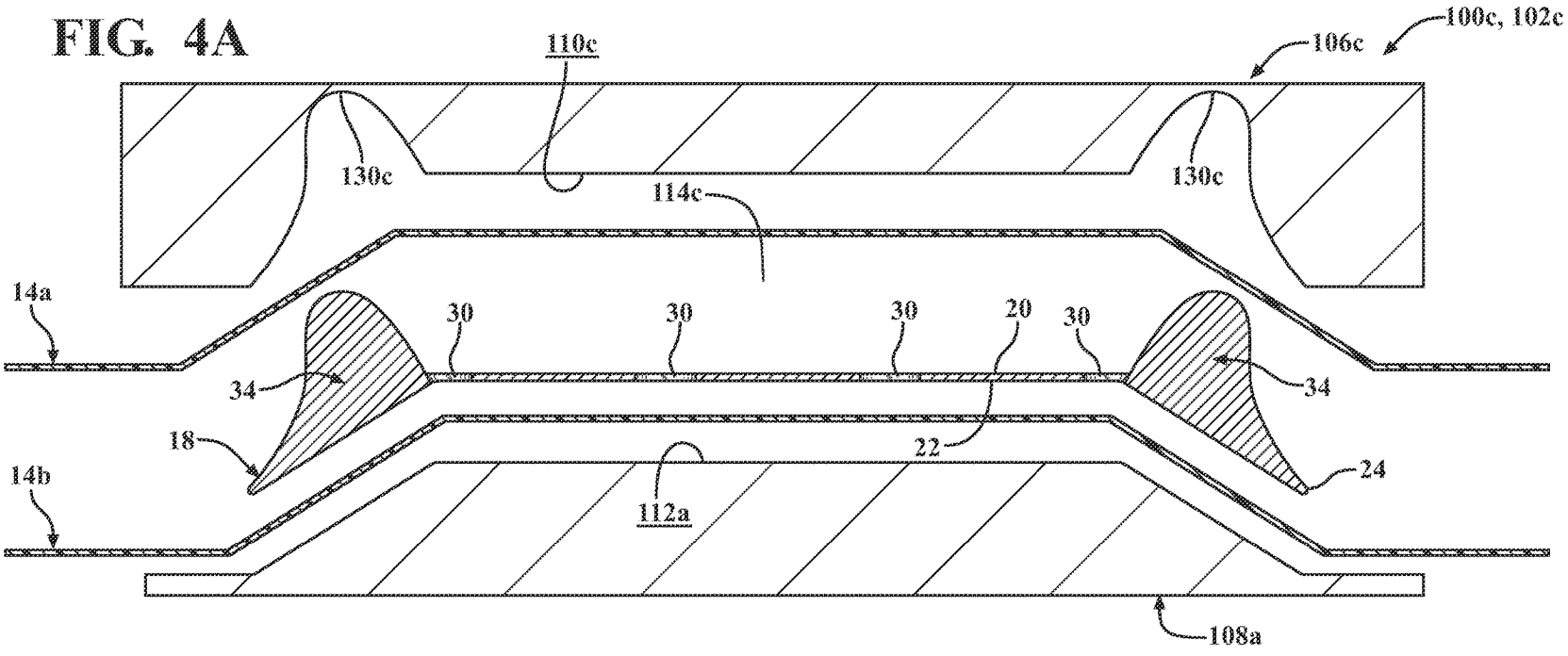
FIGS. 4A-4E are partial environmental views of a system and method for forming a configuration of a bladder in accordance with principles of the present disclosure.

As shown in FIG. 4A, in the third configuration 10*c*, the plate 18 includes a protuberance 34 formed along the flange 32 on the first side 20 of the plate 18. As discussed in greater detail below and shown in FIGS. 4A and 4D, the height of the protuberance 34 in the third configuration corresponds to a height of the peripheral subchambers 64 of the first chamber 12*a*. Accordingly, when the bladder 10 is formed, the protuberance 34 will support the inner surface 44*a* of the first outer barrier layer 16*a* within the peripheral subchamber 64, but will not impart a profile or deformation to the first outer barrier layer 16*a* when the bladder 10 is in a resting state (e.g., unaffected by external forces).

Figure 4B:
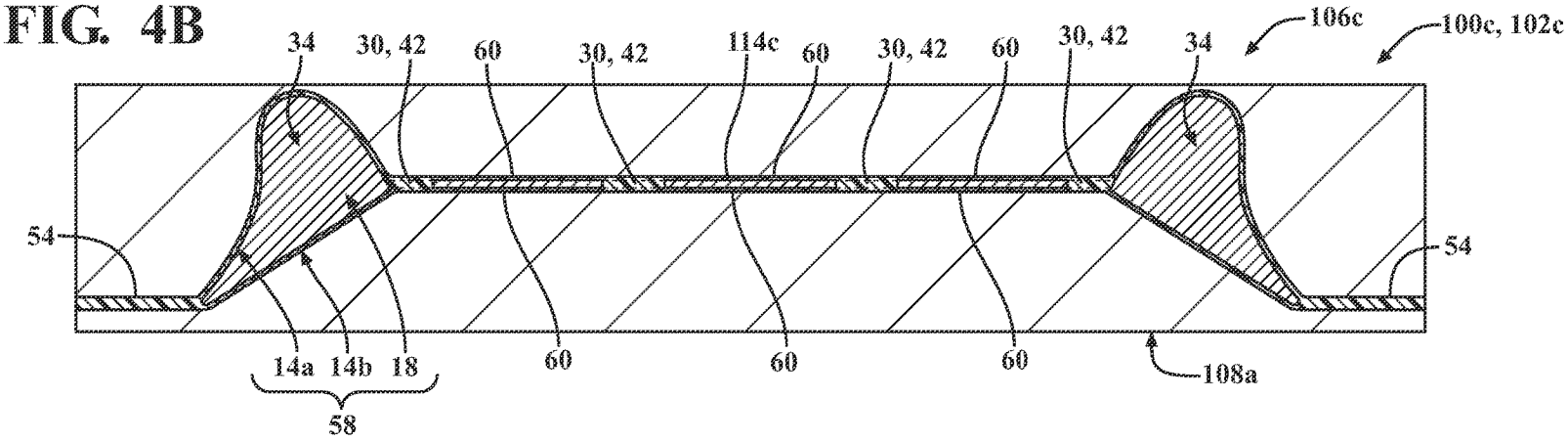

In FIG. 4B, the chassis 58 is formed for the third configuration 10*c*. Here, the chassis 58 is formed using a first tool 102*c* in the same manner as discussed above with respect to the first configuration 10*a*, except the upper mold surface 110*c* of the upper mold 106*c* has a profile corresponding to the profile of the first side 20 of the plate 18 in the third configuration 10*c*. Accordingly, the upper mold surface 110*c* has recesses 130*c* corresponding to the profile of the protuberances 34. Here, the upper mold surface 110*c* and the lower mold surface 112*a* define a mold cavity 114*c* corresponding to the profile of the fourth configuration 10*d*. When the chassis 58 is formed, the first tensile layer 14*a* conforms to the shape of the protuberances 34.

Figure 4C:
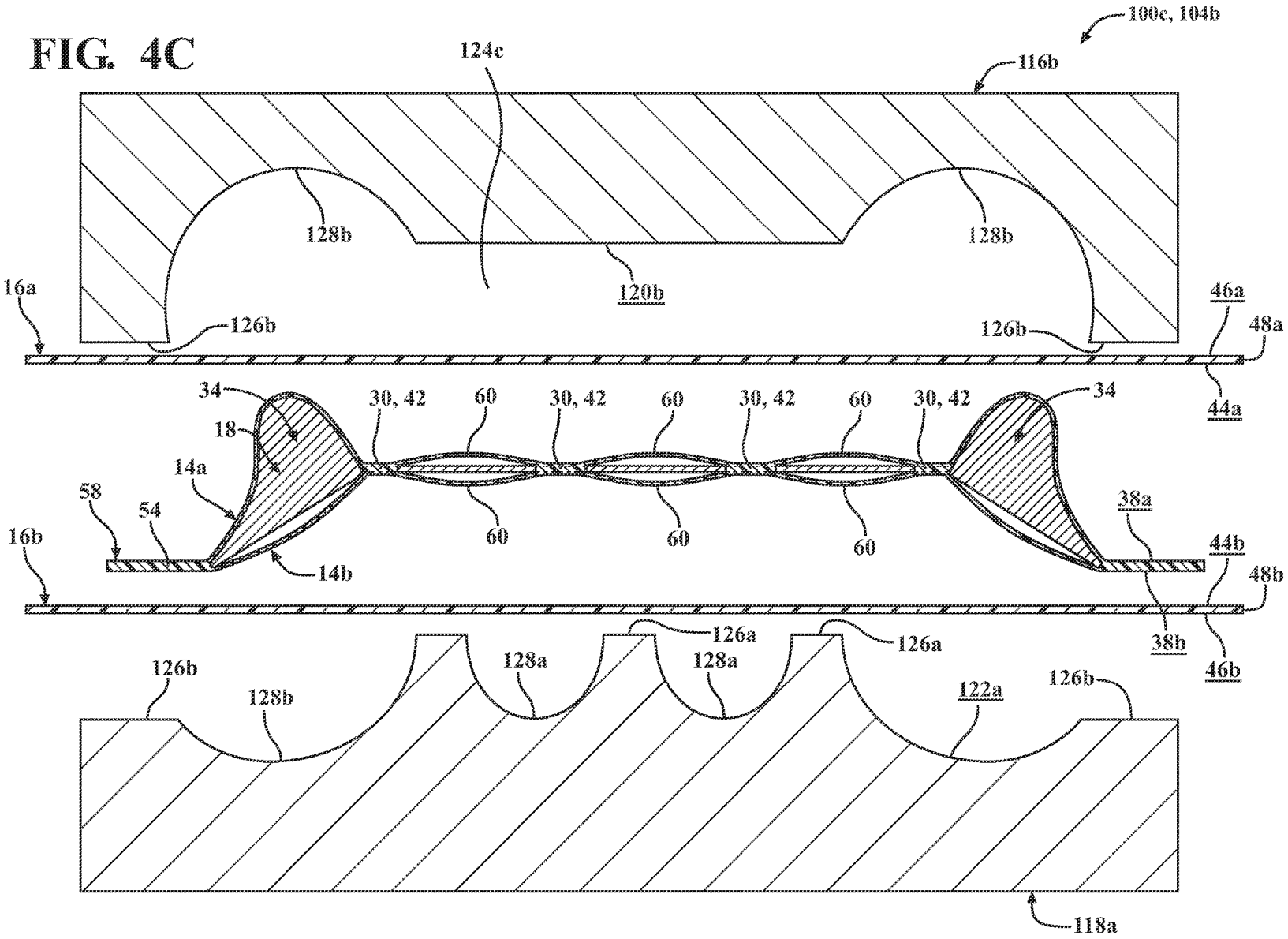
Figure 4D:
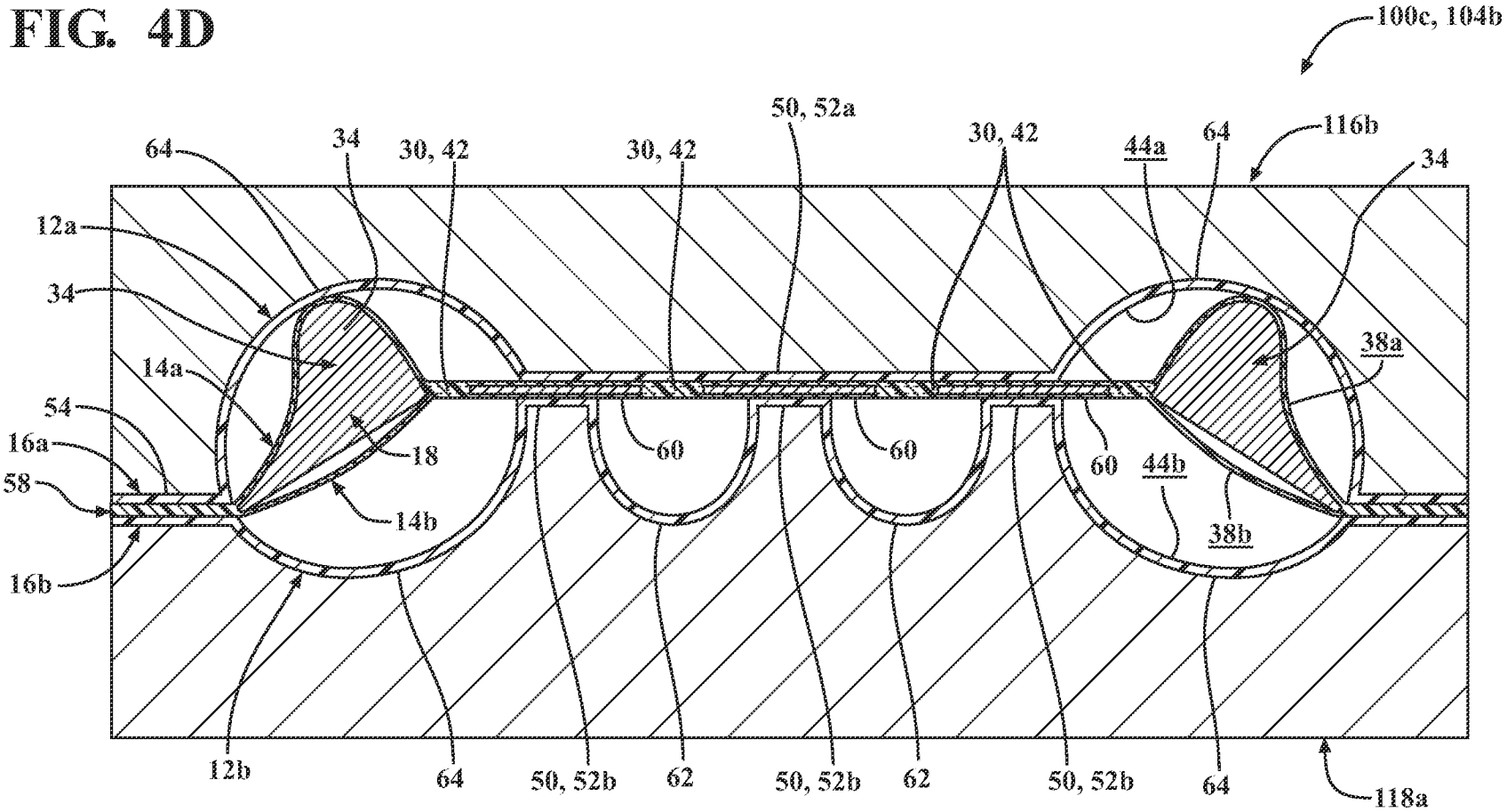
Figure 4E:
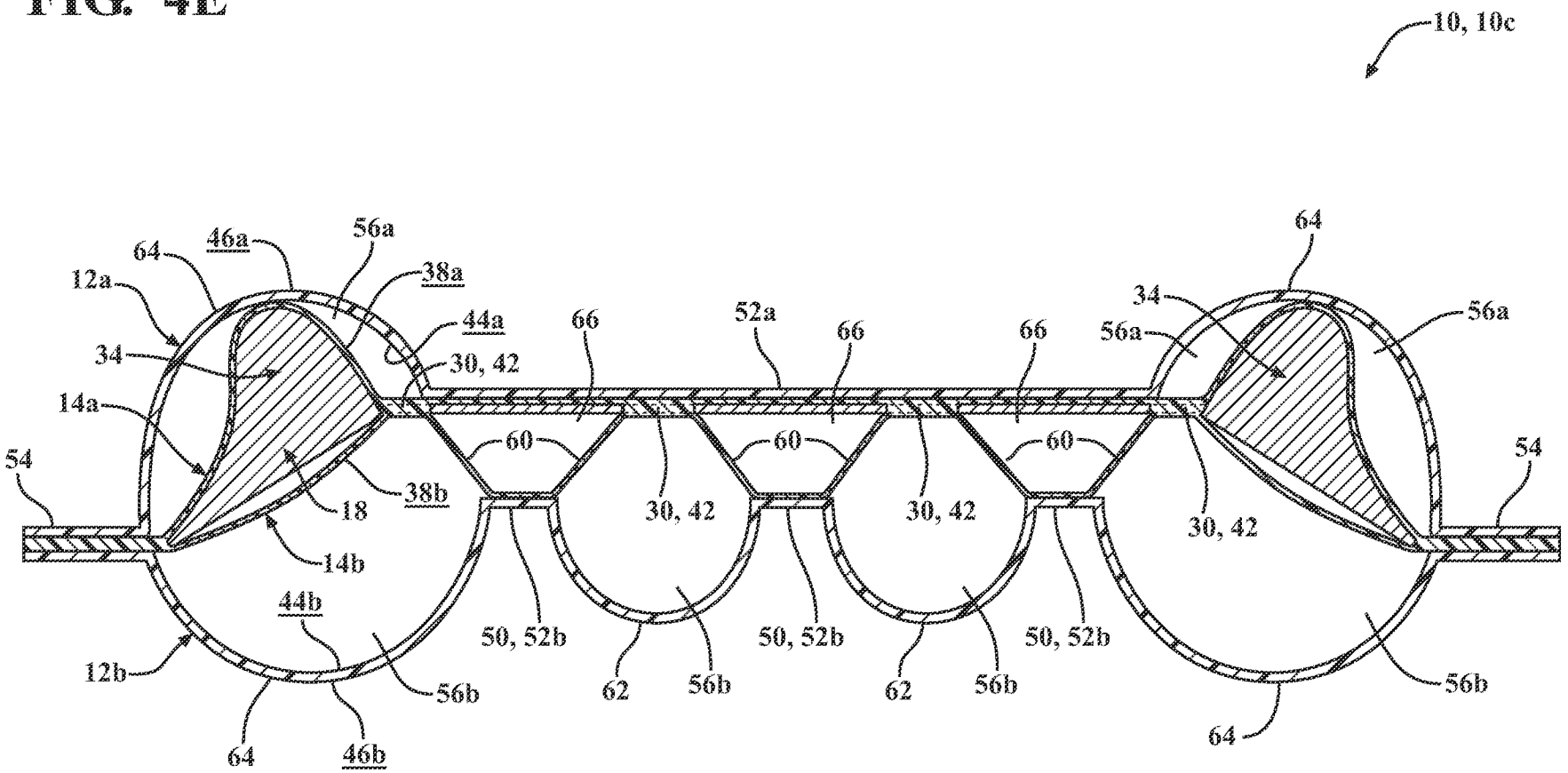

Referring to FIGS. 4C and 4D, because the protuberances 34 are configured to be confined within the profile of the peripheral subchambers 64, the third configuration 10*c* of the bladder 10 can be formed using either one of the second tools 104*a*, 104*b* used in forming the first and second configurations 10*a*, 10*b* of the bladder 10. In the illustrated example, the second tool 104*b* is configured for forming the continuous web area 52*a* in the first chamber 12*a*. However, the third configuration 10*c* may also be formed with interior subchambers 62.

With continued reference to FIG. 4D, when the system 100*c* is closed, the protuberance 34 and the first tensile layer 14*a* are contained within the portion of the peripheral subchamber 64. In the illustrated example, the outer surface 38*a* of the first tensile layer 14*a* is held in contact with the inner surface 44*a* of the first outer barrier layer 16*a* by the protuberance 34. Optionally, the first tensile layer 14*a* may be joined to the first outer barrier layer 16*a* at one or more points along the protuberance 34 within the peripheral subchamber 64. Providing the protuberance 34 within the peripheral subchamber 64 serves to provide additional structural support to the bladder 10 around the outer periphery of the foot. However, similar concepts may be utilized in other regions of the bladder 10. For example, the plate 18 may include protuberances extending into any one of the interior chambers 62 or peripheral chambers 64 of the first and/or second chamber 12*a*, 12*b*.

With particular reference to FIGS. 5A-5E, a system 100*d* and method for forming the fourth configuration 10*d* of the bladder 10 are shown. In view of the substantial similarity in structure and function of the components associated with the system 100*a* and configuration 10*a* with respect to the system 100*d* and configuration 10*d*, like reference numerals are used hereinafter and in the drawings to identify like components while like reference numerals containing letter extensions are used to identify those components that have been modified.

Figure 5A:
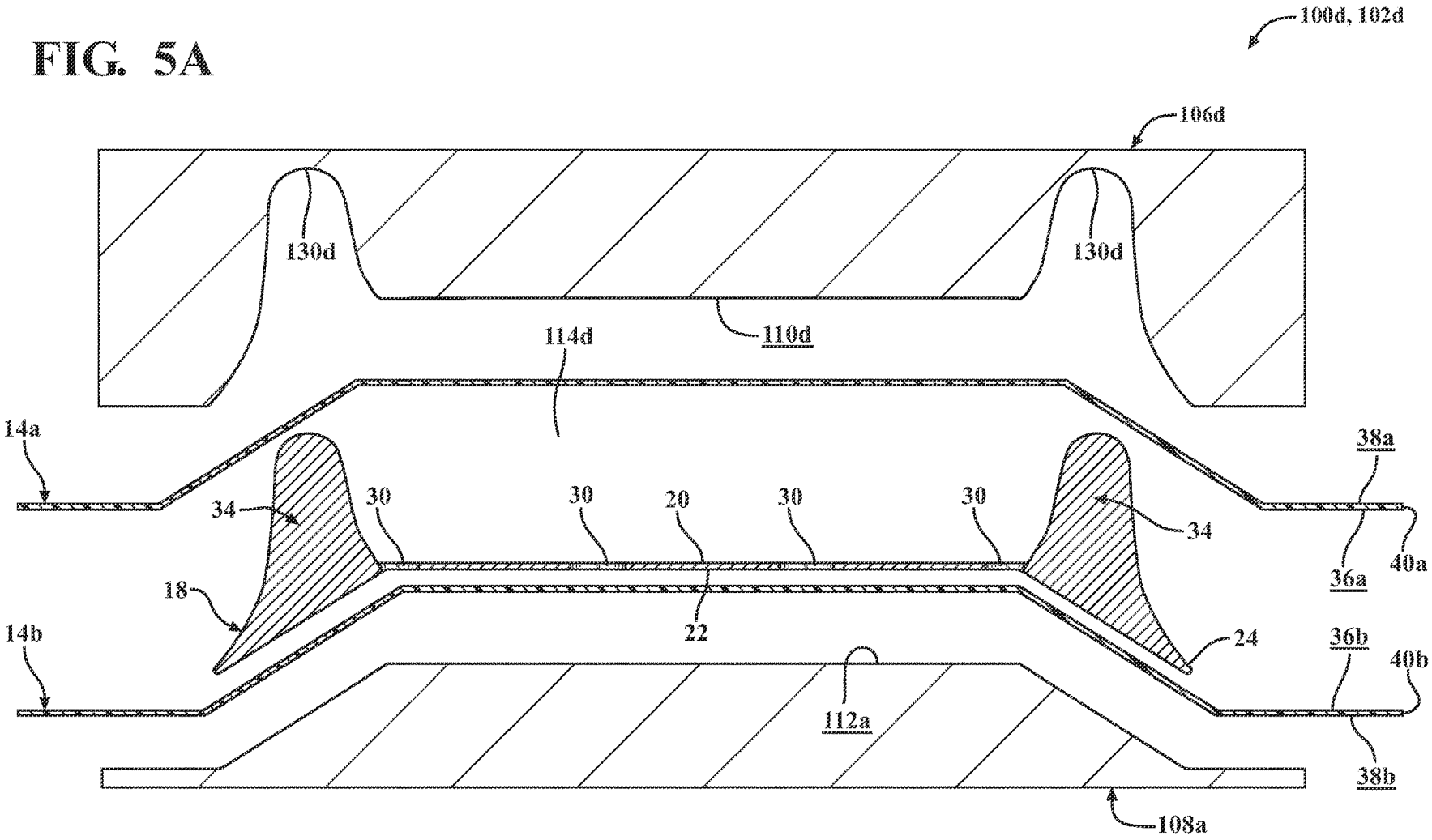
FIGS. 5A-5E are partial environmental views of a system and method for forming a configuration of a bladder in accordance with principles of the present disclosure.
Figure 5B:
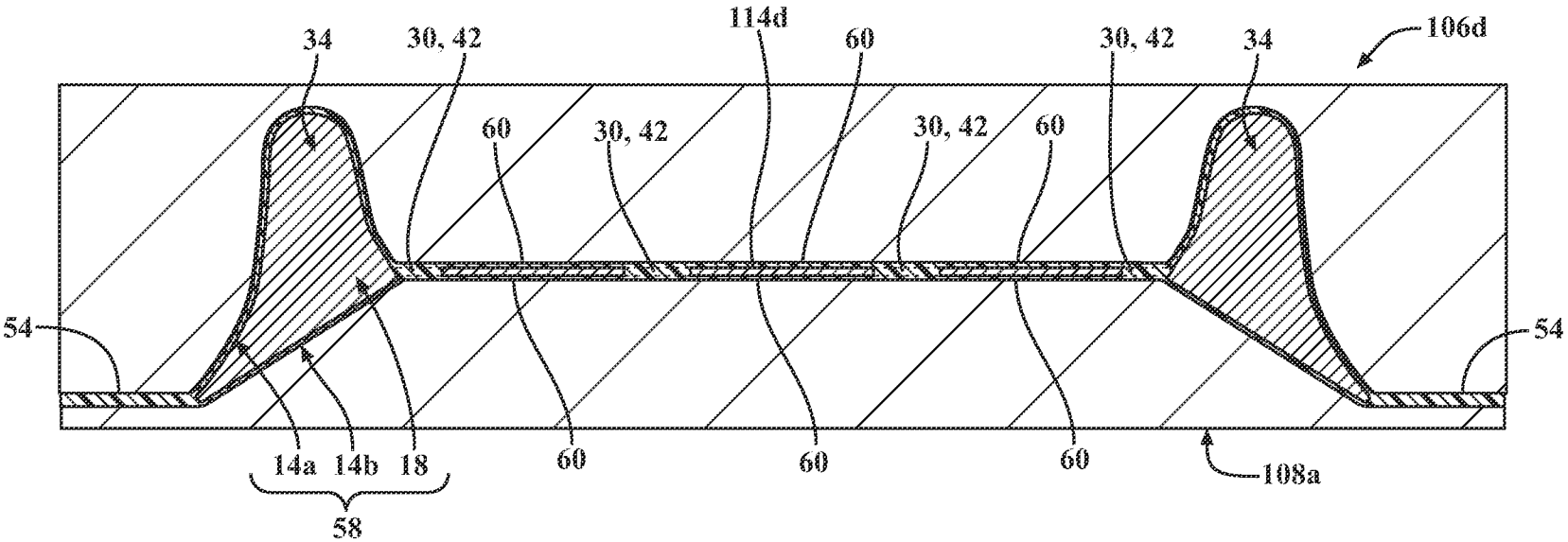
Figure 5C:
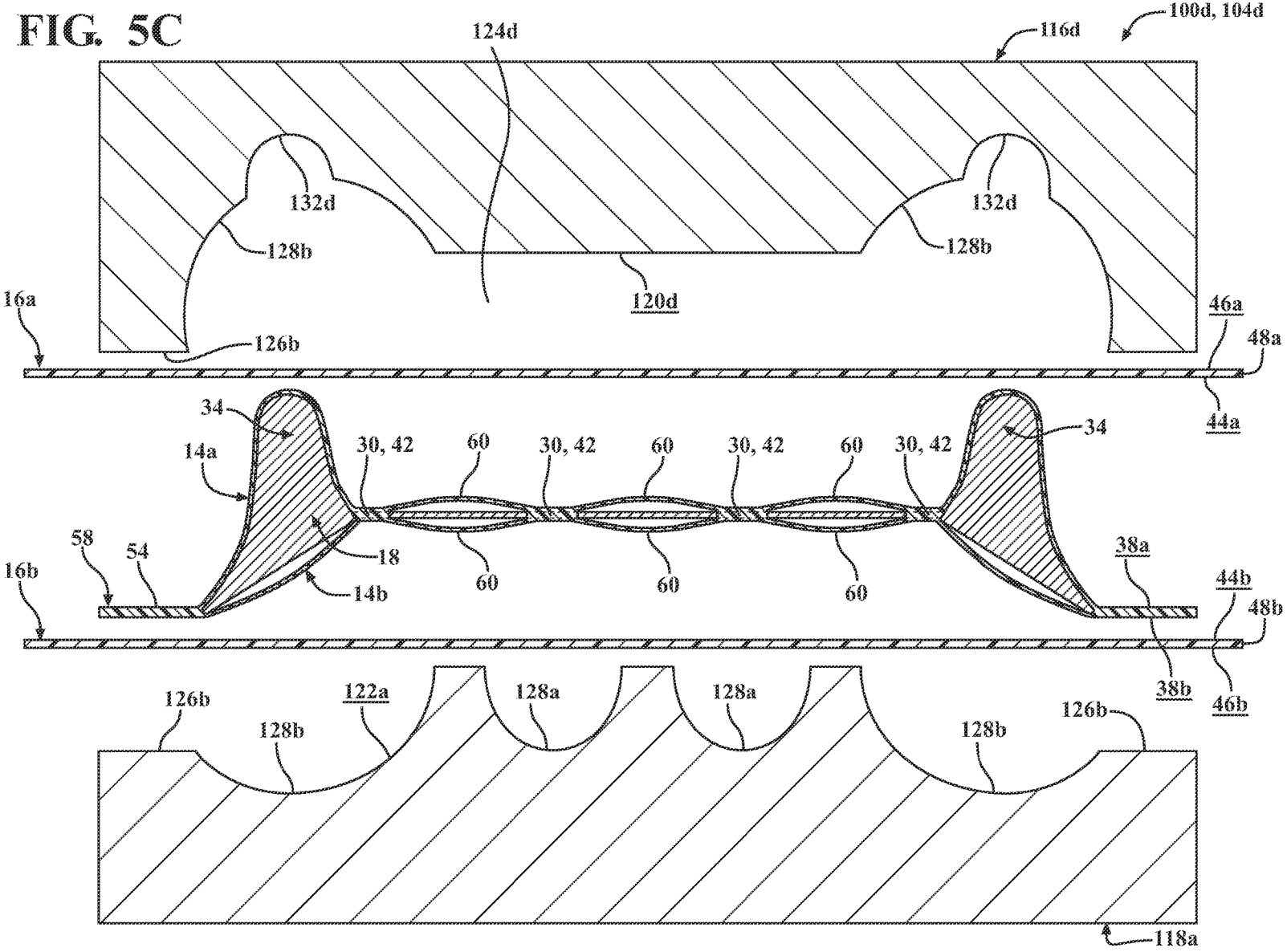
Figure 5D:
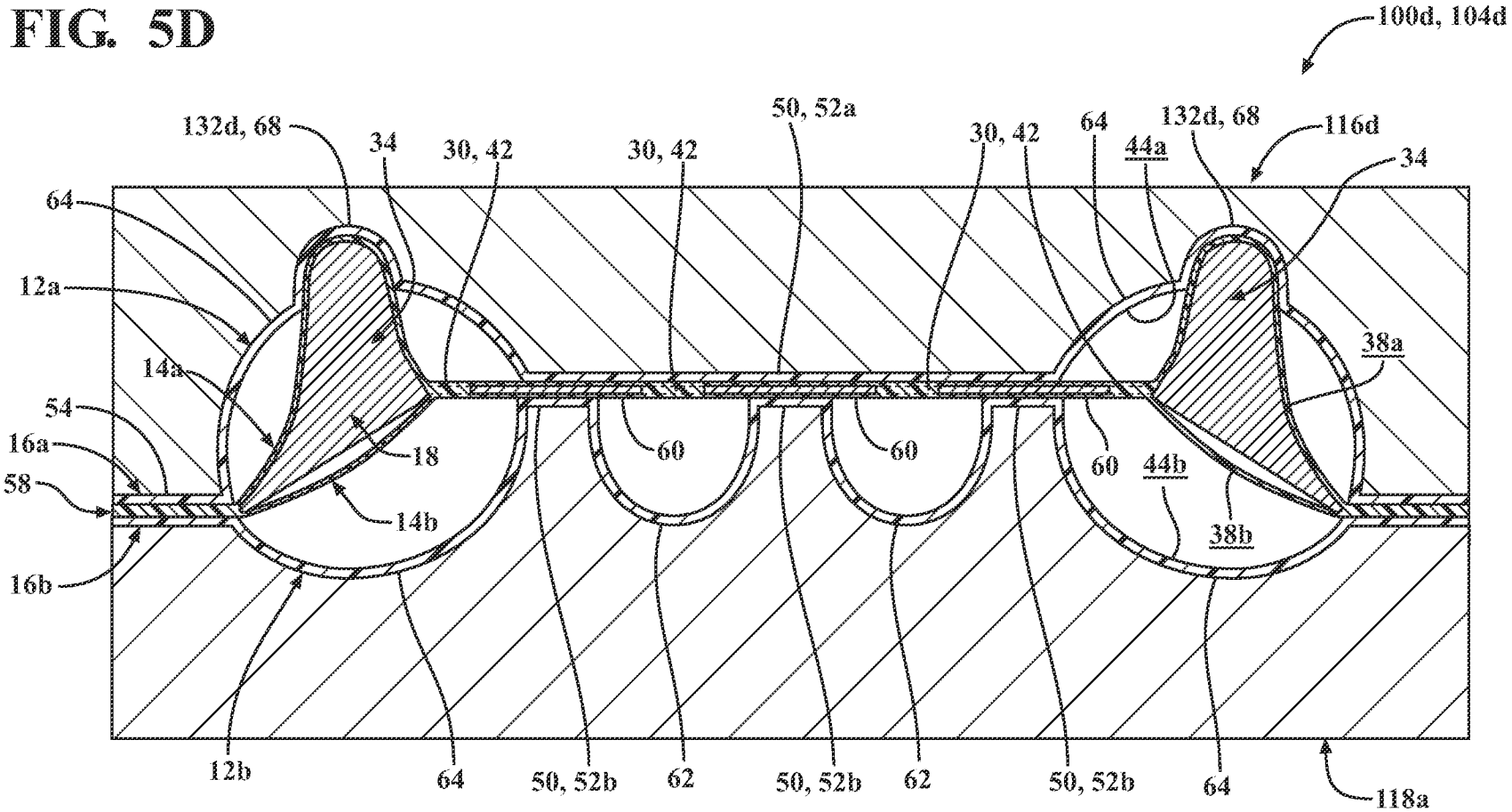
Figure 5E:
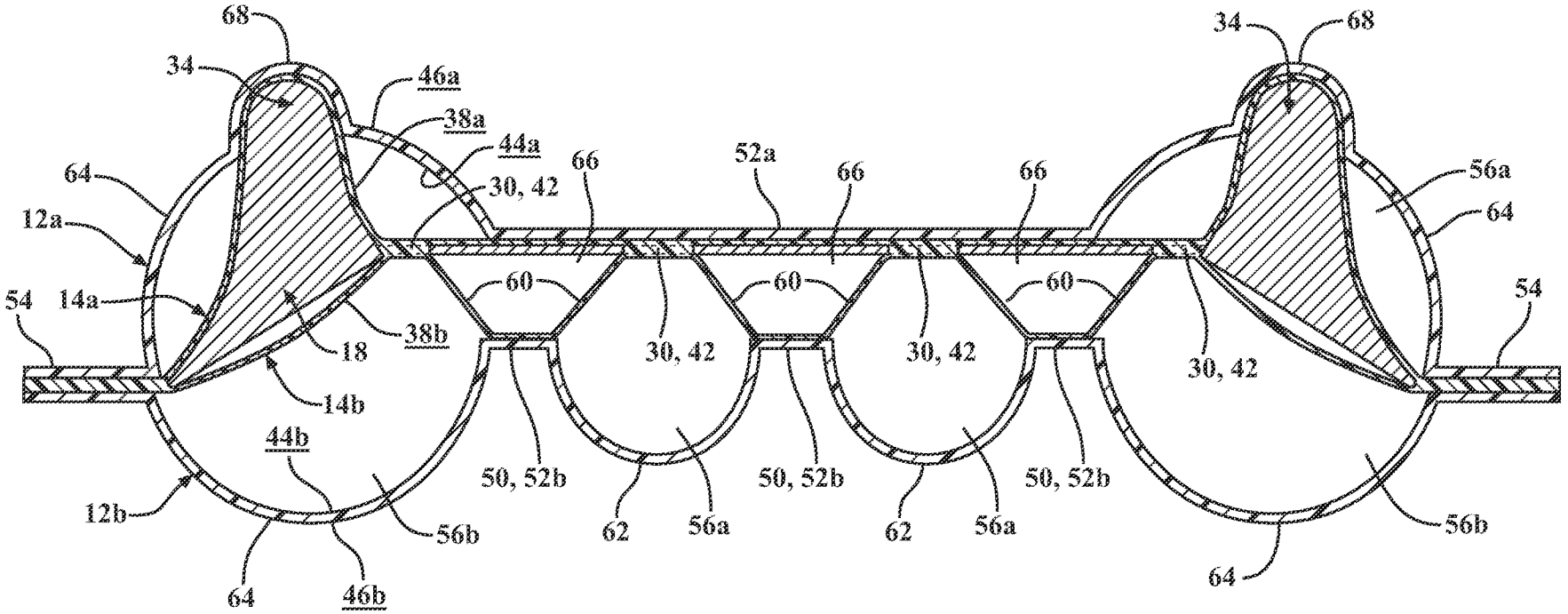

The system 100*d* and method of FIGS. 5A-5E are substantially similar to those described above with respect to FIGS. 4A-4E, where the plate 18 includes the protuberance 34 extending from the first side 20 of the flange 32. However, as best shown in FIGS. 5C and 5D, the protuberance 34 has a height that protrudes beyond the first outer barrier layer 16*a* such that a portion of the first outer barrier layer 16*a* conforms to the protuberance 34 and forms a protrusion 68 extending from the peripheral chamber 64. Accordingly, the system 100*d* is provided with a first tool 102*d* and a second tool 104*d* configured to accommodate the increased height of the protuberance 34. For instance, the upper mold 106*d* of the first tool 102*d* is formed with an upper mold surface 110*d* including recesses 130*d* having a greater height or depth than the recesses 130*d* of the upper mold 106*c* described above. Likewise, the upper mold surface 120*d* of the upper mold 116*d* of the second tool 104*d* includes indentations 132*c* formed in the peripheral recesses 128*b* for accommodating the extended protuberances 34. Accordingly, each of the first tool 102*d* and the second tool 104*d* define respective mold cavities 114*d*, 124*d* corresponding to the profile of the fourth configuration 10*d*.

Thus, in contrast to the first and second configurations 10*a*, 10*b* where the peripheral subchamber 64 is entirely filled with fluid, and the third configuration 10*c* where the protuberance 34 is contained within the natural profile of the peripheral chamber 64, in the fourth configuration 10*d*, the protuberance 34 imparts an extended profile to the peripheral subchamber 64. Again, while the illustrated example shows the protuberance 34 disposed in the peripheral portion 28 of the plate 18, the plate 18 may additionally or alternatively include projections formed in the interior portion 28 on either side 20, 22.

The systems 100*a*-100*d* and methods for forming the different configurations 10*a*-10*d* of the bladder 10 described above provide several advantages. Initially, providing the plate 18 within the bladder 10 allows an overall stiffness of the bladder 10 to be tuned. For instance, plates formed of different materials, shapes, and thicknesses may be incorporated within the bladder to provide the bladder 10 with integrated stiffness and support. In addition to providing structural benefits, the plate 18 simplifies formation of the bladder 10 by defining bonding locations 42 for the tensile layers 14*a*, 14*b*, which ultimately results in the formation of the tensile elements 60 used to constrain expansion of the outer barrier layers 16*a*, 16*b*.

Here, the use of tensile layers 14*a*, 14*b* having a material with a lower melting temperature than the material(s) of the plate 18 allows the tensile layers 14*a*, 14*b* to be joined to each other through the plate 18 in a single molding step without affecting the properties of the plate 18. These tensile layers 14*a*, 14*b* offer multiple benefits. For example, the tensile layers 14*a*, 14*b* provide a simplified tensile structure within the barrier layer, whereby the tensile elements 60 are simply formed by attaching the tensile layers 14*a*, 14*b* to each other at discrete locations. Additionally, the tensile layers 14*a*, 14*b* isolate the first chamber 12*a* and the second chamber 12*b*, such that the first chamber 12*a* can be pressurized with a different pressure than the second chamber 12*b*. Accordingly, the barrier 10 may be tuned with first and second chambers 12*a*, 12*b* having different pressures and shapes.

The following Clauses provide an exemplary configuration for a bladder for an article of footwear described above.

Clause 1: A bladder for an article of footwear, the bladder comprising a plate, a first tensile layer disposed adjacent to a first side of the plate, a second tensile layer disposed on an opposite side of the plate from the first tensile layer, the second tensile layer joined to the first tensile layer through the plate by a plurality of inner bonds, and a first barrier layer disposed adjacent to the first tensile layer and joined to the first tensile layer by a plurality of first outer bonds to form a first chamber, one or more of the first outer bonds interposed between adjacent ones of the inner bonds.

Clause 2: The bladder of Clause 1, wherein the first tensile layer and the second tensile layer are formed of a first elastomeric material and the first barrier layer is formed of a second elastomeric material different from the first elastomeric material.

Clause 3: The bladder of Clause 2, wherein the first elastomeric material has a lower melting temperature than the second elastomeric material.

Clause 4: The bladder of any of the preceding Clauses, further comprising a second barrier layer disposed adjacent to the second tensile layer and joined to the second tensile layer by a plurality of second outer bonds to form a second chamber on the opposite side of the plate than the first chamber.

Clause 5: The bladder of Clause 4, wherein the first chamber is fluidly isolated from the second chamber by at least one of the first tensile layer and the second tensile layer.

Clause 6: The bladder of Clause 4, wherein the first chamber has a different pressure than the second chamber.

Clause 7: The bladder of any of the preceding Clauses, wherein the plate includes a plurality of apertures extending through the plate and each of the inner bonds is formed within one of the apertures.

Clause 8: The bladder of any of the preceding Clauses, wherein the second tensile layer is joined to the first tensile layer around a periphery of the plate.

Clause 9: The bladder of any of the preceding Clauses, wherein the first tensile layer and the second tensile layer are detached from the plate between the inner bonds to form one or more tensile elements.

Clause 10: The bladder of Clause 9, wherein each of the first outer bonds is formed with one of the tensile elements.

Clause 11: A bladder for an article of footwear, the bladder comprising a plate having one or more apertures, a first tensile layer disposed adjacent to a first side of the plate, a second tensile layer disposed on an opposite side of the plate from the first tensile layer and joined to the first tensile layer within each of the one or more apertures, and a first barrier layer disposed adjacent to the first tensile layer and joined to the first tensile layer at discrete locations to form a first chamber.

Clause 12: The bladder of Clause 11, wherein the first tensile layer and the second tensile layer are formed of a first elastomeric material and the first barrier layer is formed of a second elastomeric material different from the first elastomeric material.

Clause 13: The bladder of Clause 12, wherein the first elastomeric material has a lower melting temperature than the second elastomeric material.

Clause 14: The bladder of any of the preceding Clauses, further comprising a second barrier layer disposed adjacent to the second tensile layer and joined to the second tensile layer by a plurality of second outer bonds to form a second chamber on the opposite side of the plate than the first chamber.

Clause 15: The bladder of Clause 14, wherein the first chamber is fluidly isolated from the second chamber by at least one of the first tensile layer and the second tensile layer.

Clause 16: The bladder of Clause 14, wherein the first chamber has a different pressure than the second chamber.

Clause 17: The bladder of any of the preceding Clauses, wherein the second tensile layer is joined to the first tensile layer around a periphery of the plate.

Clause 18: The bladder of any of the preceding Clauses, wherein the first tensile layer and the second tensile layer are detached from the plate between the apertures to form one or more tensile elements.

Clause 19: The bladder of Clause 18, wherein the first barrier layer is attached to each of the one or more tensile elements of the first tensile layer.

Clause 20: The bladder of Clause 18, wherein the first barrier layer is attached to the first tensile layer along each of the apertures.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

The invention claimed is:

1. A bladder for an article of footwear, the bladder comprising:

a plate having a variable thickness;

a first tensile layer disposed adjacent to a first side of the plate;

a second tensile layer disposed on an opposite side of the plate from the first tensile layer, the second tensile layer bonded to the first tensile layer through the plate by a plurality of distinct inner bonds; and a first barrier layer disposed adjacent to the first tensile layer and joined to the first tensile layer by a plurality of first outer bonds to form a first chamber, one or more of the first outer bonds interposed between adjacent ones of the inner bonds.

2. The bladder of claim 1, wherein the first tensile layer and the second tensile layer are formed of a first elastomeric material and the first barrier layer is formed of a second elastomeric material different from the first elastomeric material.

3. The bladder of claim 2, wherein the first elastomeric material has a lower melting temperature than the second elastomeric material.

4. The bladder of claim 1, further comprising a second barrier layer disposed adjacent to the second tensile layer and joined to the second tensile layer by a plurality of second outer bonds to form a second chamber on the opposite side of the plate than the first chamber.

5. The bladder of claim 4, wherein the first chamber is fluidly isolated from the second chamber by at least one of the first tensile layer and the second tensile layer.

6. The bladder of claim 4, wherein the first chamber has a different pressure than the second chamber.

7. The bladder of claim 1, wherein the plate includes a plurality of apertures extending through the plate and each of the inner bonds is formed within one of the apertures.

8. The bladder of claim 1, wherein the second tensile layer is joined to the first tensile layer around a periphery of the plate.

9. The bladder of claim 1, wherein the first tensile layer and the second tensile layer are detached from the plate between the inner bonds to form one or more tensile elements.

10. The bladder of claim 1, wherein the plate includes at least one protrusion.

11. A bladder for an article of footwear, the bladder comprising:

a plate having a plurality of apertures and one or more protrusions;

a first tensile layer disposed adjacent to a first side of the plate;

a second tensile layer disposed on an opposite side of the plate from the first tensile layer and bonded to the first tensile layer to form a distinct bond within each aperture of the plurality of apertures; and a first barrier layer disposed adjacent to the first tensile layer and joined to the first tensile layer at discrete locations to form a first chamber.

12. The bladder of claim 11, wherein the first tensile layer and the second tensile layer are formed of a first elastomeric material and the first barrier layer is formed of a second elastomeric material different from the first elastomeric material.

13. The bladder of claim 12, wherein the first elastomeric material has a lower melting temperature than the second elastomeric material.

14. The bladder of claim 11, further comprising a second barrier layer disposed adjacent to the second tensile layer and joined to the second tensile layer by a plurality of second outer bonds to form a second chamber on the opposite side of the plate than the first chamber.

15. The bladder of claim 14, wherein the first chamber is fluidly isolated from the second chamber by at least one of the first tensile layer and the second tensile layer.

16. The bladder of claim 14, wherein the first chamber has a different pressure than the second chamber.

17. The bladder of claim 11, wherein the second tensile layer is joined to the first tensile layer around a periphery of the plate.

18. The bladder of claim 11, wherein the first tensile layer and the second tensile layer are detached from the plate between apertures of the plurality of apertures to form one or more tensile elements.

19. The bladder of claim 18, wherein the first barrier layer is attached to each of the one or more tensile elements of the first tensile layer.

20. The bladder of claim 18, wherein the first barrier layer is attached to the first tensile layer at each of the plurality of apertures.

* * * * *